United States Patent [19]

Holland

[11] Patent Number: 4,880,363

[45] Date of Patent: Nov. 14, 1989

[54] WELL PUMP SYSTEM

[75] Inventor: John H. Holland, Norman, Okla.

[73] Assignee: John and Martin Holland and Associates, Norman, Okla.

[21] Appl. No.: 202,413

[22] Filed: Jun. 6, 1988

Related U.S. Application Data

[60] Division of Ser. No. 906,260, Sep. 11, 1986, Pat. No. 4,778,355, which is a continuation-in-part of Ser. No. 615,300, May 30, 1984, Pat. No. 4,611,974.

[51] Int. Cl.[4] ..... F04B 47/04

[52] U.S. Cl. ..... 417/390

[58] Field of Search ..... 417/390, 383, 385, 386, 417/387, 388

[56] References Cited

U.S. PATENT DOCUMENTS

| | | | |
|---|---|---|---|
| 3,123,007 | 3/1964 | Orr | 417/390 X |
| 4,234,295 | 11/1980 | Jensen | 417/390 |
| 4,600,368 | 7/1986 | Sommer | 417/390 X |

*Primary Examiner*—Leonard E. Smith

*Attorney, Agent, or Firm*—Hubbard, Thurman, Turner & Tucker

[57] ABSTRACT

Vertical reciprocation of the piston in a downhole well pump is hydraulically effected by surface-disposed power transfer apparatus comprising a driving fluid housing divided into first and second chambers by a drive piston reciprocably disposed therein, the first chamber being connected to the driving fluid chamber of the well pump by a driving fluid pipe. The pipe and the first housing chamber are filled with a first driving fluid. A driving fluid pump has an outlet connected to the second housing chamber, and an inlet connected to a source of a second driving fluid. During operation of the driving fluid pump a valved piping circuit associated therewith causes the pump to alternately force second driving fluid into the drive housing to force the well pump piston through its upstroke, and them permit the well pump piston to fall through its downstroke and responsively force second driving fluid out of the drive housing and back through the driving fluid pump to assist in driving the same during downward movement of the well pump piston.

5 Claims, 8 Drawing Sheets

WELL PUMP SYSTEM

CROSS REFERENCE TO RELATED APPLICATION

This application is a division of U.S. application Ser. No. 906,260 filed on Sept. 11, 1986, now U.S. Pat. No. 4,778,355 which was a continuation-in-part of U.S. application Ser. No. 615,300 filed on May 30, 1984 now U.S. Pat. No. 4,611,974.

BACKGROUND OF THE INVENTION

1. Field of the Invention

The present invention pertains to a well pump system for producing well fluids. The pump system includes a reciprocating piston downhole pump which utilizes the pressure of a column of hydraulic driving fluid or a gas over liquid accumulator and a column of production fluid for driving the pump. One embodiment uses a mechanical actuating rod and production fluid pressure for driving the pump. The driving fluid may be displaced by a hydraulically driven cylinder and piston type power transfer unit on the surface.

2. Background

In the art of downhole pumps for lifting fluids from wells and other subterranean reservoirs there are several concepts which have been relatively well developed including the so-called sucker rod type pump which comprises a reciprocating piston pump disposed deep in the well at the point from which fluid is to be pumped and which is actuated from the surface solely by an elongated reciprocating rod string. There have also been several developments in downhole well pumps which are hydraulically operated in an effort to overcome some of the disadvantages of the mechanical rod type pump. Typically, prior art hydraulically operated pumps, sometimes known as power oil pumps, comprise a reciprocating piston pump located in the wellbore and having opposed pistons or piston surfaces defining power oil chambers and production fluid chambers, respectively. Hydraulic or "power" oil is pumped down the well through a suitable conduit connected to the reciprocating piston pump for actuating the pump to deliver a charge of production fluid through a delivery line to the surface. In some types of power oil pumps the power oil is mixed with the production fluid in the delivery line as a means of returning the power oil to the surface. Accordingly, this so-called power oil must be suitably treated before it can be recirculated by the power oil delivery pump back to the well pump for further energization of the well pump. This type of hydraulically operated pump is relatively complicated and requires expensive and troublesome filtering systems for treating the fluid which is used as "power" oil. Other types of hydraulically operated pumps have been developed which provide separate delivery and return conduits for the hydraulic "power oil" and, of course, a third conduit is required for the production fluid.

Those skilled in the art will appreciate that the prior art hydraulically operated pumps which utilize either mixed production and power oil or separate closed loop power oil systems can be relatively inefficient. The power oil must be circulated down the hole and returned requiring relatively complex conduit systems, in the case of a separate or isolated power oil circuit, and the circulation of mixed or separate power oil completely down through the supply conduit and through the return conduit results in frictional losses which increase the overall power requirements for a given quantity of production fluid produced. Prior art pumps are also characterized by designs which lift production fluid on both strokes of the pump thereby complicating the pump structure itself.

Known types of well pumping systems also suffer from certain shortcomings such as the inability to be effectively regulated to pump at the desired production rate of the well. In this regard, known types of pumping systems are also at a disadvantage because of the economics of producing from low production or marginal wells, particularly wells for producing petroleum fluids. There must, of course, be economic justification for producing hydrocarbon fluids from subterranean wells. If the pumping costs and the capital equipment costs exceed the expected yield of the well or a low marginal net profit results there is little incentive to develop or produce from such formations and wells.

Accordingly, there has been an ongoing need for a downhole well pump which minimizes the capital equipment cost, may be inserted in a well without substantial modification to the existing well structure, may be inserted in wells which are deviated and cannot be produced using mechanical rod actuated pumps and which should be pumped at very low or variable rates to prevent overpumping the well and damaging the formation characteristics as well as the pump mechanism.

There has also been a need for an improved well pump system which can be conveniently installed in existing wells which are relatively inaccessible or for various reasons cannot be pumped utilizing equipment which extends above the earth's surface at the wellhead or takes up a great deal of room at the wellhead.

Substantially all of the disadvantages of known types of downhole well pump systems have been overcome with the hydraulically operated and combined mechanical and hydraulically operated pump system of the present invention as will be appreciated by those skilled in the art upon reading the following.

SUMMARY OF THE INVENTION

In carrying out principles of the present invention, in accordance with a preferred embodiment thereof, surface-disposed power transfer apparatus is provided for hydraulically causing vertical reciprocation of piston means in a downhole well pump operatively disposed in a wellbore, the well pump having a driving fluid chamber therein adapted to receive a quantity of pressurized driving fluid to responsively cause the piston means to lift, and to discharge the received driving fluid during downward movement of the piston means.

The power transfer apparatus includes a driving fluid housing having reciprocably disposed therein a drive piston which divides the housing into first and second chambers. A driving fluid pipe is interconnected between the first housing chamber and the driving fluid chamber of the well pump, the first housing chamber and the driving fluid pipe being filled with a first driving fluid.

A driving fluid pump portion of the power transfer apparatus has an inlet adapted to receive a second driving fluid from a source thereof, and an outlet communicating with the second chamber of the driving fluid housing. Valved circuit means operatively interconnect the driving fluid pump and housing and function, during operation of the driving fluid pump, to alternately:

1. cause the driving fluid pump to draw second driving fluid from the source thereof and discharge it into the second housing chamber to thereby force first driving fluid out of the first housing chamber and into the driving fluid pipe which, in turn, forces first driving fluid from within the pipe into the well pump driving fluid chamber to cause the well pump piston means to rise; and 2. permit the well pump piston means to fall to thereby force first driving fluid from the driving fluid chamber into the driving fluid pipe, and from within the driving fluid pipe into the first housing chamber in a manner responsively forcing second driving fluid outwardly from the second housing chamber and inwardly through the inlet of the driving fluid pump to assist in driving the same during downward movement of the well pump piston means.

BRIEF DESCRIPTION OF THE DRAWINGS

FIG. 15 is a schematic diagram of a third alternate embodiment of a well pump system in accordance with the invention;

FIG. 16A is a longitudinal central section view of a portion of a third alternate embodiment of a downhole pump for use with the system of FIG. 15;

FIG. 16B is a continuation of FIG. 16A from the line 16—16;

FIGS. 17A and 17B are cross-sectional views through longitudinal portions of a further alternate embodiment of a well pump incorporating principles of the present invention;

FIG. 18 is a cross-sectional view through the upper piston assembly dome portion of the pump illustrated in FIGS. 17A;

FIG. 19 is a reduced scale perspective view of the upper piston assembly;

FIG. 20 is a schematic diagram of a power transfer system used to hydraulically drive the pump of FIGS. 17A and 17B;

FIGS. 21A and 21B are simplified fragmentary views of the upper half of the pump of FIGS. 17A and 17B, partially in cross-section and partially in elevation, and illustrate a unique horizontal assembly method therefor;

FIGS. 22A and 22B are cross-sectional views through longitudinal portions of a modified lower half of the pump illustrated in FIGS. 17A and 17B; and FIG. 23 is a schematic diagram of an alternate embodiment of the power transfer system of FIG. 20.

DESCRIPTION OF THE PREFERRED EMBODIMENTS

Figure 1:
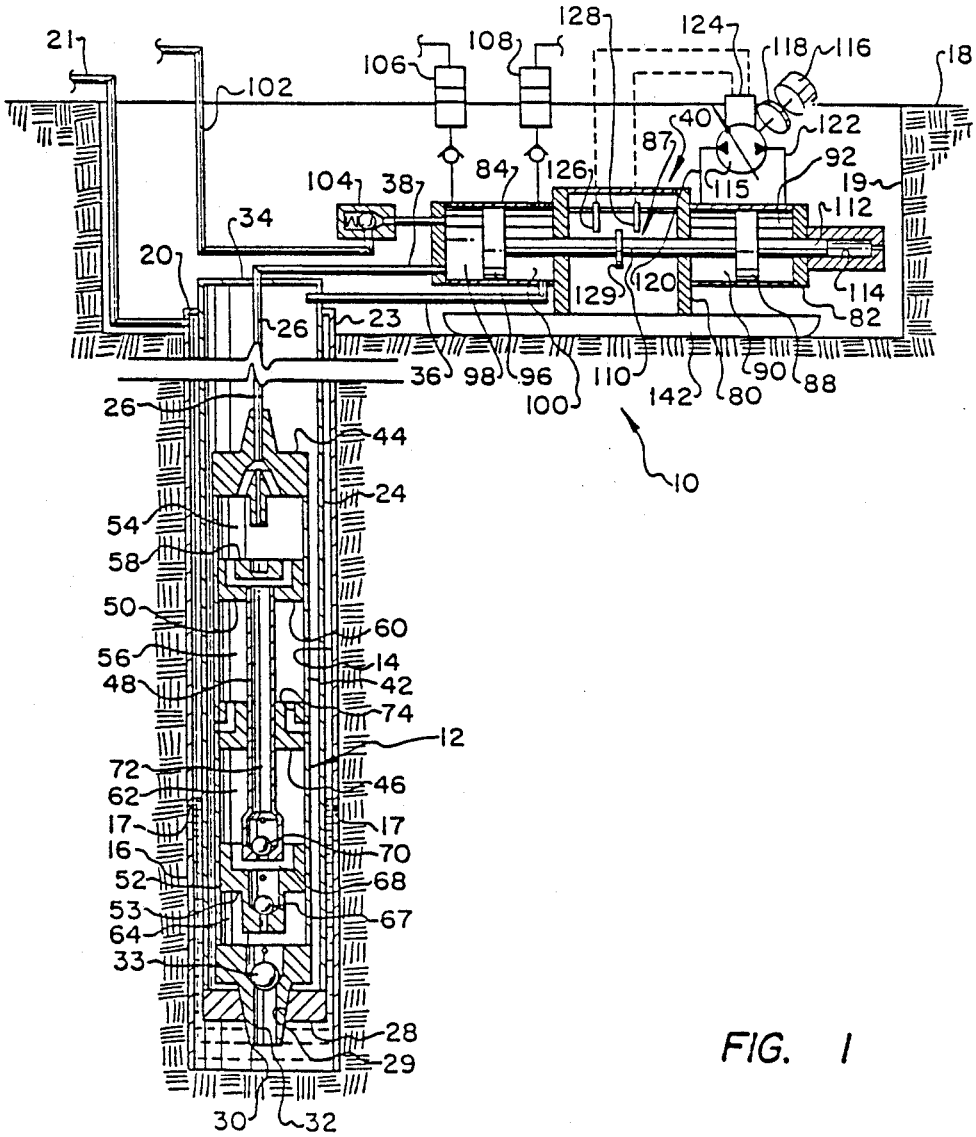
FIG. 1 is a diagram, in somewhat schematic form, of a hydraulically operated well pump system of the present invention.

In the description which follows like parts are marked throughout the specification and drawing with the same reference numerals, respectively. The drawing figures are not necessarily to scale and certain features of the invention have been shown exaggerated in scale or in schematic or diagrammatic form in the interest of clarity and conciseness.

Referring to FIG. 1, there is illustrated in somewhat schematic form a unique hydraulically operated well pumping system in accordance with the present invention and generally designated by the numeral 10. The pumping system 10 includes a downhole pump 12 adapted to be inserted in a wellbore 14. The wellbore 14 may be a cased or uncased well and for the sake of description herein will be indicated to have a casing 16 which has been suitably perforated at 17 to allow subterranean formation fluids to flow into the wellbore 14. The casing 16 may extend substantially to the earth's surface 18 as provided by a shallow pit 19 and be capped at 20 to form a wellhead 23. Suitable conduit means 21 are provided below or above the surface 18 for pressurizing the wellbore 14 and/or for conducting gas away from the wellbore, if required.

The pumping system 10 also includes an arrangement of coaxial conduits comprising an outer driving fluid conduit 24 and an inner production fluid conduit 26 which is arranged preferably coaxially within the driving fluid conduit. The driving fluid conduit 24 is preferably provided at its lower end with an end cap 28 having a central bore 29 through which a tapered bottom head portion 30 of the pump 12 projects and forms a fluid inlet port 32. The conduit 24 may, in fact, be characterized as conventional so-called production tubing typically used for producing hydrocarbon fluids from subterranean wells. The conduit 24 may extend to the surface and is provided with a cap 34 to form a closed conduit. The conduit 24 may, in fact, terminate in a typical wellhead apparatus, not shown, including the upper end of the casing 16. The aforementioned wellhead apparatus is not believed to require illustration in detail in order to understand and practice the present invention. The production fluid conduit 26 typically extends through the end cap 34 of the driving fluid conduit 24 and both the driving fluid conduit and the production fluid conduit include respective conduit extension portions 36 and 38 which lead to a power transfer apparatus for the pumping system 10, and which is generally designated by the numeral 40.

Figure 2:
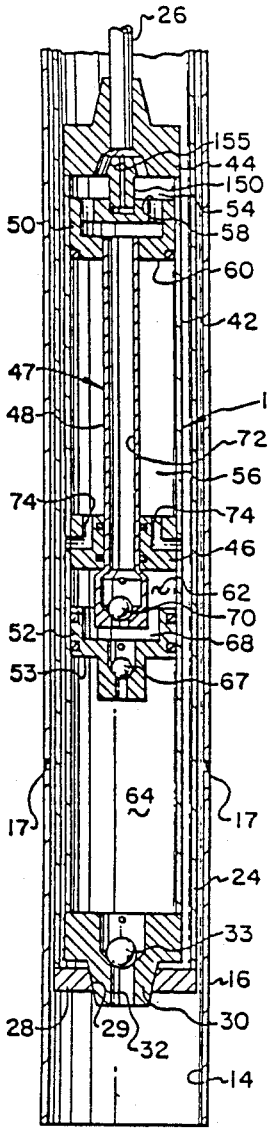
FIGS. 2 through 5 illustrate the downhole pump of the present invention in various positions in an operating cycle.

Referring to FIGS. 1 and 2, the downhole pump 12 is further characterized by an elongated cylindrical housing 42 which is closed at one end by the head part 30 and at the other end by a second head part 44 connected to the production fluid conduit 26. The housing 42 includes a partition 46 formed therein and through which extends an elongated tubular piston rod 48 which is connected at its upper end to a first piston 50 and the lower end of the piston rod 48 is connected to a second piston 52. The first piston 50 is slidably disposed in the housing 42 and divides the housing into a production fluid transfer chamber 54 and a driving fluid chamber 56. Accordingly, production fluid acts downwardly on a piston face 58 and driving fluid may be admitted to the chamber 56 to act upwardly on the opposite piston face 60 of the piston 50. The chamber 54 operates to transfer production fluid from a chamber 62 on an upstroke of piston assembly 47 and functions as a production "power" fluid chamber on a piston downstroke.

The piston 52 divides the lower end of the housing 42 into the production fluid delivery chamber 62 and a production fluid intake chamber 64 which is operable to be in communication with the wellbore 14 through the intake port 32. The piston assembly 47, comprising the tubular rod 48 and the spaced pistons 50 and 52, is provided with passage means for conducting production fluid from the chamber 64 to the chambers 54 and 62 as well as passage means for conducting production fluid from the chamber 62 to the chamber 54. A ball type one way or check valve 67 is supported by the piston 52 and interposed in a passage 68 which interconnects the chambers 64 and 62. A second ball type check valve 70 is interposed between a passage 72 in the piston rod 48 and the chamber 62. A third ball type check valve 33 may be provided, as shown, interposed in the port 32 and operable for admitting production fluid from wellbore 14 to the chamber 64.

In response to an upward movement of the piston assembly 47 toward head 44 production fluid is simultaneously displaced from chamber 62 and chamber 54 into the production fluid conduit 26 toward the power transfer apparatus 40 under the urging of pressure fluid admitted to the driving fluid chamber 56 through passages 74 in the partition 46. The passages 74 open through the housing 42 and are operable to communicate the chamber 56 with the interior of the driving fluid conduit 24 at all times. Thanks to the substantial fluid pressure exerted on the piston face 60 by a standing column of fluid in the driving fluid conduit 24, the piston assembly 47 may be driven through a fluid delivery stroke, during which the check valve 67 is closed and the check valve 70 is open, whereby production fluid is transferred out of the chamber 62 and the chamber 54 toward the power transfer apparatus 40. During a production fluid delivery stroke check valve 33, if used, opens to admit production fluid from wellbore 14 to chamber 64. The pressure of a standing column of production fluid in the wellbore 14 may be sufficient to act on piston face 53 to assist in driving the piston assembly 47 through a production fluid delivery stroke.

The standing columns of fluid in the conduits 24 and 26 are considered to be essentially of the same length, so that the fluid pressures acting on the pump piston 50 due to fluid in the conduits 24 and 26 depend on respective fluid densities. The face areas 58 and 60 of the piston 50 may be selected in combination with the respective densities of the production fluid and the driving fluid such that a net resultant force due to the pressure of the fluid columns acting on the piston assembly 47 will cause the piston assembly 47 to be balanced, biased towards the completion of an upward delivery stroke or towards the completion of a downward intake or fluid transfer stroke, respectively, as well conditions might require. In the pump system 10 water may be used as the driving fluid, having a density which may be greater than the well fluid. The opposed piston face areas of piston 50 may be selected such that when the production fluid conduit 26 is filled with production fluid and the conduit 24 is filled with driving fluid the piston assembly 47 is balanced, if desired, or biased downward, viewing FIG. 1, to maximize the volume of the chambers 54 and 62. Moreover, the upward bias force on the piston assembly 47 can be controlled in accordance with a predetermined pressure to be maintained in wellbore 14 and acting on piston face 53.

The power transfer apparatus 40 is characterized by a frame 80 supporting horizontally opposed cylinder members 82 and 84. The cylinder 82 is provided with a cylindrical bore in which a piston 88 is disposed and divides the bore into opposed motor chambers 90 and 92. The cylinder 84 is also provided with a cylindrical bore in which is disposed a piston 96 dividing the bore into a production fluid chamber 98 and a driving fluid chamber 100. The driving fluid conduit 24, 36 is in communication with the chamber 100 and the production fluid delivery conduit 26, 38 is in communication with the chamber 98. A production fluid delivery conduit 102 is also in communication with the chamber 98 and has a minimum pressure valve 104 interposed therein for maintaining a minimum pressure in the chamber 98 in response to reciprocation of the piston 96 to scavenge the chamber 98. The delivery conduit 102 may be connected to a suitable reservoir, not shown, or other means for receiving production fluid from the wellbore 14. The chambers 98 and 100 may be maintained at a predetermined minimum pressure by accumulators, 106 and 108, respectively, for maintaining a predetermined minimum pressure of the production fluid and the driving fluid so as to negate any adverse effects resulting from compressibility of the respective fluids in particularly deep wells. The accumulators 106 and 108 may be connected to respective sources of pressure fluid, not shown, at controllable pressures. The compressibility of the production and driving fluids themselves may serve the accumulator function with an initial charge pressure applied to the fluid columns and considering elastic expansion of steel or similar metal tubing used for the conduits 24 and 26.

The pistons 88 and 96 are preferably arranged coaxial with each other in their respective cylinders and are interconnected by a piston rod 110 supported for sliding movement on the frame 80 to form a piston assembly 87. The piston rod 110 includes an integral extension 112 received in a bore 114 of an extension of the cylinder 82 so that the opposed transverse faces of the piston 88 are of equal axial projected areas. The power transfer apparatus 40 is actuated by suitable means including a hydraulic pump 115 drivably connected to a suitable motor 116 through a flywheel 118. The fluid intake and delivery conduits 120, 122 of pump 115 are connected to the cylinder chambers 90 and 92 for delivering hydraulic fluid to the respective chambers in a cyclic manner to effect reciprocation of the piston assembly 87. The pump 115 may be of a type which is operable to reverse the direction of flow in the respective fluid conducting lines 120 and 122. Alternatively, the lines 120 and 122 could be in communication with a reversing valve between the pump 115 and the cylinder 82.

In accordance with an embodiment of the invention the pump 115 is of the so-called overcenter axial piston type wherein flow through the lines 120 and 122 may be reversed by actuation of a suitable pump controller 124 in response to signals received from suit-able control means such as spaced apart adjustable limit switches 126 and 128 which are engageable, respectively, by an actuator 129 mounted on piston rod 110. The relative positions of switches 126 and 128 on frame 80 may be adjusted to control the stroke length of the pistons 88 and 96 and, accordingly, the stroke of pump 12 by controlling the flow direction of fluid delivered by pump 115 to the respective chambers 90 and 92. Alternatively, the controller 124 may be mechanically interconnected with the piston rod 110 in such a way that, as the piston assembly 87 reaches a predetermined limit of a stroke in one direction, the pump controller 124 is actuated to reverse the direction of flow in the pump fluid lines 120 and 122 to reverse the direction of movement of the piston assembly 87. The pump 115 may be of a type manufactured by the Rexroth Corporation, Mobile Hydraulics Division, Wooster, OH as their type AA4V. This is a swashplate type variable displacement overcenter axial piston pump designed for closed circuit power transmission systems. Certain detailed features including filters, heat exchangers, and conventional pump controls are not shown in the diagram of FIG. 1 and are not believed to be necessary in order to enable one skilled in the art to practice the instant invention. Suffice it to say that the pump 115 is reversible in the sense that it is operable to effect reversal of hydraulic fluid flow in the conduits connected to the pump to effect reciprocation of the piston assembly 87.

Those skilled in the art will appreciate that the power transfer apparatus 40 may be modified to include other means for reciprocating the piston 96 although the hydraulic power source comprising the pump 115, motor 116, and flywheel 118 provides a particularly compact low profile apparatus which may be mounted on a suitable skid 142. Moreover, the apparatus 40 may be mounted remote from the wellbore 14 or may be disposed in pit 19 below the surface 18 for aesthetic and/or functional reasons depending on the location of the well in which the pumping system 10 is being used.

Referring now to FIGS. 2 through 5, a typical operating cycle of the pumping system 10 will be described. FIG. 2 shows the pump 12 in the maximum upstroke position wherein driving fluid has displaced the piston assembly 47 to sweep the chambers 54 and 62 of production fluid. The combined displacement volume of chambers 54 and 62 exceeds the displacement volume of chamber 98 by the volume of chamber 62, preferably. Accordingly, during an upstroke of the piston assembly 47 a net amount of production fluid equal to the volume of chamber 62 passes through chamber 98 and is delivered to line 102. In the position of pump 12 shown in FIG. 2 the power transfer apparatus piston assembly 87 would be displaced its maximum distance to the right, viewing FIG. 1. The direction of flow through the lines 120 and 122 is then reversed such that hydraulic fluid from the pump 115 is being supplied to the chamber 92 and scavenged from the chamber 90 whereby the piston assembly 87 will be moved leftward, viewing FIG. 1, to displace production fluid from the chamber 98 back into conduit 26. As production fluid is displaced from the chamber 98, driving fluid may flow from the conduit 24 into the chamber 100. The weight of the column of fluid in the production conduit 26 will effect movement of the piston assembly 47 downward, viewing FIG. 3, to expand the chambers 54 and 62.

As the pump 12 is moved through a stroke cycle to the position illustrated in FIG. 2, production fluid in the wellbore 14 has flowed through port 32 into chamber 64 to substantially fill this chamber with production fluid. Accordingly, as the piston assembly 47 commences moving downward to the positions indicated in FIGS. 3 and 4, valve 33, if used, closes to prevent displacement of production fluid back into the wellbore 14 and valve 70 seats under the urging of fluid in chamber 54 and passage 72 as fluid in the conduit 26 returns into the chamber 54 to urge piston 50 downwardly. During the downstroke of piston assembly 47 valve 67 unseats to permit transfer of fluid from chamber 64 to chamber 62. Typically, the maximum displacement volume of chamber 64 is not substantially more than the maximum displacement volume of chamber 62, although if valve 33 is omitted this volume relationship is not significant. As the piston assembly 47 is moving downwardly driving fluid is displaced out of chamber 56 and upward through the conduit 24 and toward chamber 100.

Figure 4:
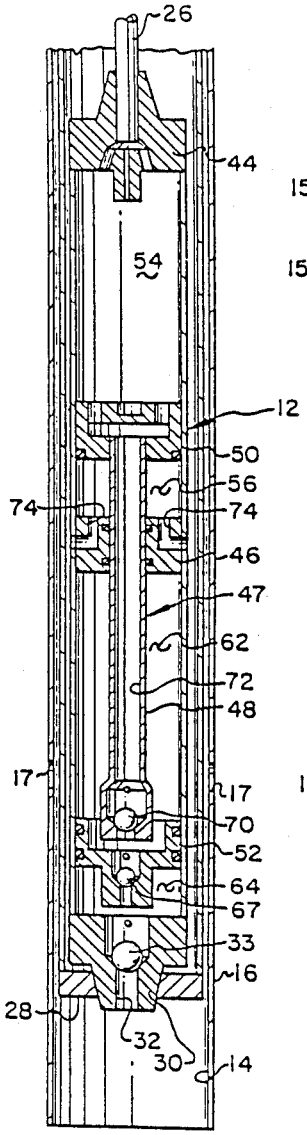

When the piston assembly 47 reaches the lower limit of its stroke as indicated by the position of the piston assembly in FIG. 4, the chambers 54 and 62 are filled completely with production fluid from conduit 26 and transferred from the intake chamber 64, respectively. At this point, the power transfer apparatus 40 has reversed the direction of movement of the piston assembly 87 to commence displacing driving fluid out of chamber 100, through the conduit 24 and into chamber 56 whereby the piston assembly 47 is now urged upward which effects closure of the valve 67. As the piston assembly 47 moves from the FIG. 4 position, through the FIG. 5 position and back to the FIG. 2 position production fluid is displaced from the chamber 62 through valve 70 and passage 72 and to chamber 54, and, simultaneously, production fluid is being displaced from chamber 54 through the production delivery conduits 26 and 38 into and through the chamber 98 and into the production delivery line 102. During movement of the piston assembly 47 from the FIG. 4 position to the position of FIG. 2 chamber 64 will again fill with production fluid.

Figure 5:
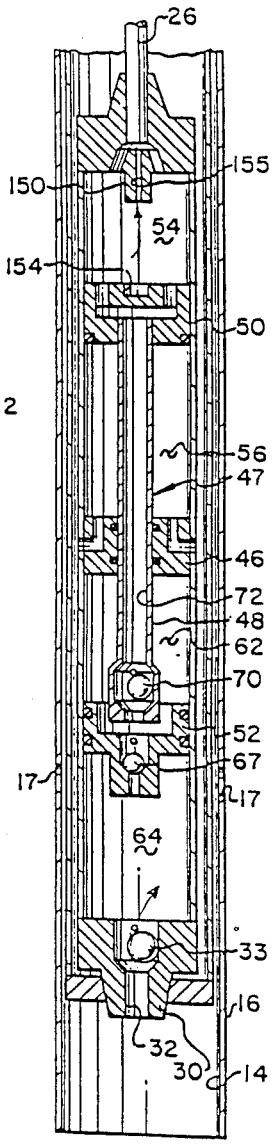

As the piston assembly 47 moves upward through the delivery stroke illustrated in FIG. 5 to the position illustrated in FIG. 2, the piston 50 will engage a hydraulic cushion forming means comprising a generally cylindrical projection 150 disposed in the chamber 54 and forming part of the head assembly 44. The projection 150 enters a chamber 154 formed in the face of the piston 50 whereby fluid trapped in the chamber 154 by the projection 150 is allowed to flow at a substantially throttled rate through a suitable passage 155 formed in the head 44.

Figure 3:
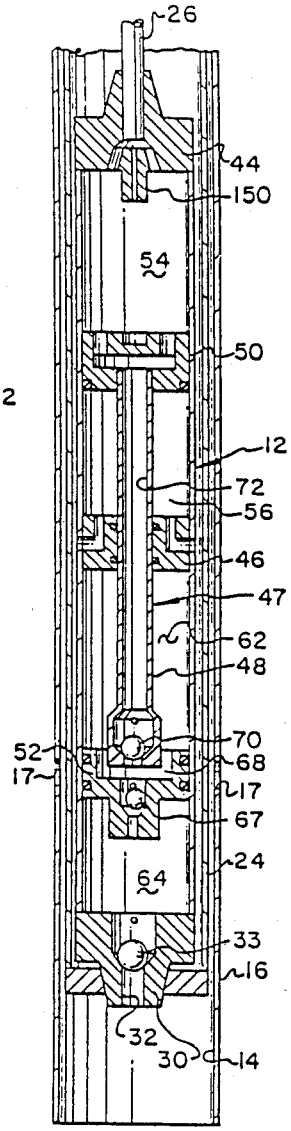

Accordingly, the pump 12 is operable to deliver a net quantity of production fluid comprising the displacement of the chamber 62 as the piston assembly 47 moves through a cycle from the position illustrated in FIG. 2 through the positions illustrated in FIGS. 3, 4 and 5 and back to the position illustrated in FIG. 2. This displacement takes place with relatively low frictional flow losses of the driving fluid since the fluid only oscillates over a very limited distance in a relatively large diameter, substantially unrestricted conduit. Moreover, depending on the density of the driving fluid in relation to the density of the production fluid and the selection of the effective axially projected areas of the piston faces 58 and 60, the pump piston assembly 47 may be biased in an upward or downward stroke limit position or balanced by the net resultant forces acting on the piston assembly. Of course, the height of the column of production fluid standing in the wellbore 14 is also operable to bias the piston assembly 47 upward through its action on the axially projected face area 53 of the piston 52. As previously mentioned, the power transfer apparatus 40 may be adapted to operate at a virtually infinitely variable rate whereby the piston assembly 47 may be stroked through a so-called suction and discharge stroke cycle at a rate which matches the desired rate of fluid delivery from the wellbore.

Although the height of the column of production fluid in the wellbore 14 results in a relatively low pressure on the piston face 53 pressure force acting on this face may be significant enough so that in conjunction with providing a pressure relief setting for the hydraulic fluid being discharged from the pump 115 through line 120, that during a cycle of the power transfer unit to force driving fluid into the chamber 56, if the pressure force urging the piston assembly 47 upwardly is not sufficient considering the total force exerted on the piston face 53 and piston face 60 pressure fluid being bypassed from the line 120 may be sensed as to flow or heat build up to shut down the pump 12 until pressure in the wellbore 14 again increases to a point sufficient to contribute to the lifting force on the piston assembly 47. In this way control of the pump rate of a well may be obtained without the danger of overpumping.

The use of the check valve 33 is dependent on the production fluid flow conditions into the wellbore 14. Typically, the displacement volume of chamber 64 is selected to be slightly greater than the displacement volume of chamber 62. The check valve 33 should be installed in applications of the pump 12 wherein a relatively high percentage of gases are dissolved in or entrained in the production fluid. Since pressure in the wellbore 14 acting on the check valve 33 effects opening of the valve on a downstroke of the piston assembly 47 use of the check valve 33 aids in preventing overpumping or so called gas lock of the pump. In wells with very high liquid content of the production fluid the check valve 33 is preferably omitted.

Figure 6:
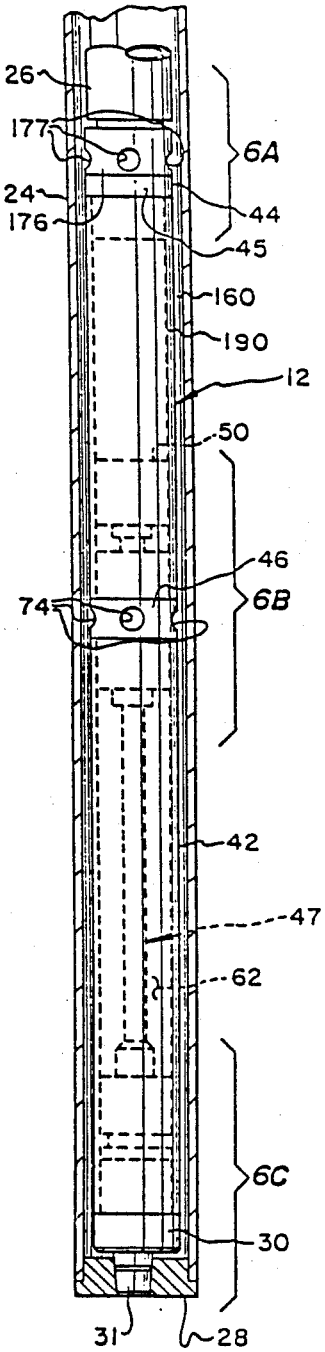
FIG. 6 is a longitudinal elevation view of the downhole pump inserted in a wellbore.
Figure 6A:
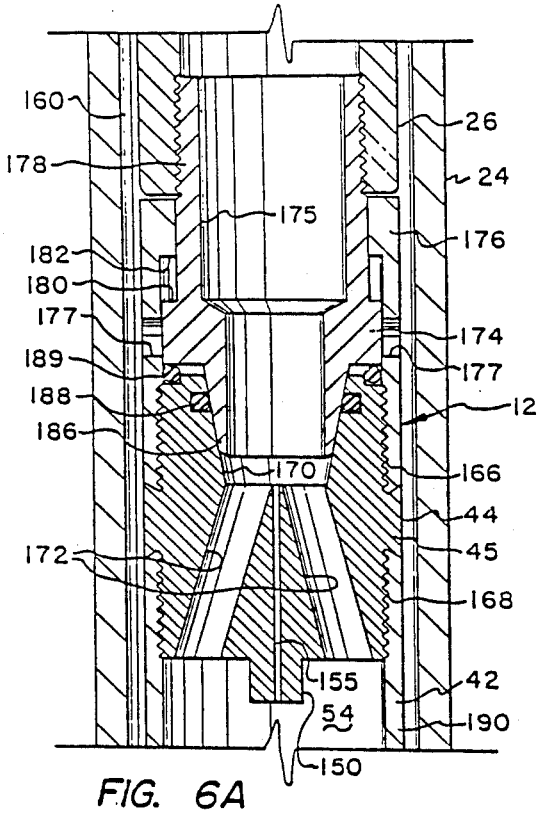
FIGS. 6A, 6B and 6C are partial longitudinal central section views of respective portions of the downhole pump as indicated in FIG. 6.
Figure 7:
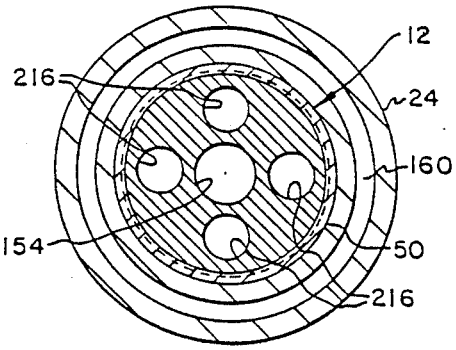
FIG. 7 is a section view taken along line 7—7 of FIG. 6B.
Figure 6B:
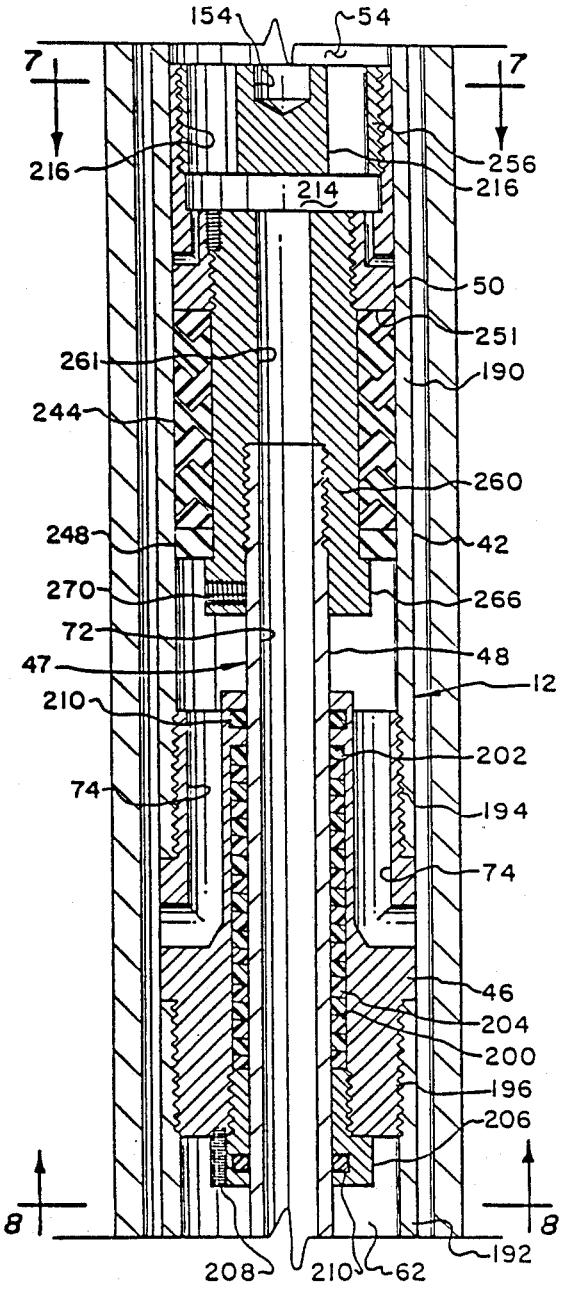
Figure 6C:
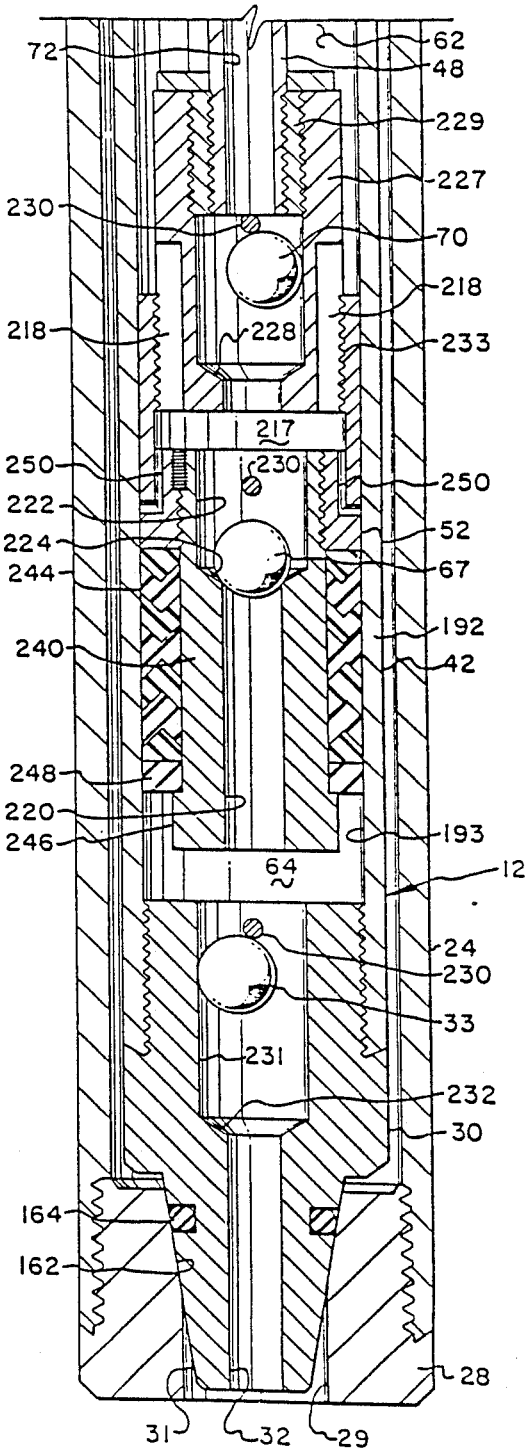

Referring now to FIGS. 6, 6A and 6C, the pump 12 is shown in FIG. 6 disposed in the lower end of the driving fluid conduit 24 in fluid sealing engagement with the conduit end cap 28. The pump 12 is characterized as a long slender cylindrical structure defined by the housing 42, the lower head member 30 and the upper head member 44. The housing 42 is dimensioned to be disposed in the driving fluid conduit 24 to leave a substantially annular space 160 between the housing 42 and the interior bore wall of the driving fluid conduit. The pump 12 is centered within the interior of the driving fluid conduit 24 by a frusto-conical shaped projecting end portion 31 of the head 30 which is adapted to engage a seat 162 formed as part of the bore 29 in end cap 28. An o-ring seal 164 is provided for sealing engagement between the end portion 31 and the seat 162. As shown in FIG. 6A, the head member 44 includes a body 45 with opposed externally threaded portions 166 and 168 and a frusto-conical seat 170 which is in communication with the passage 155 and with flow passages 172 opening into the chamber 54.

A coupling member 174 is retained connected to the pump 12 by a retaining collar 176 threadedly engaged with the portion 166 of the body 45 and retaining the coupling member 174 for limited axial sliding movement relative to the head member 44. The upper end 178 of coupling member 174 is threadedly connected to the lower end of the production fluid conduit 26 and is engageable with the retaining collar 176 at cooperating shoulders 180 and 182. The lower end of the coupling member 174 comprises a frusto-conical shape closure member 186 which is engageable with the seat 170 to form a fluid-tight seal including cooperating seal rings 188 and 189. The coupling member 174 includes an axial flow passage 175 which communicates the chamber 54 with the production fluid conduit 26 and, in response to axial upward lifting movement by the conduit 26, the coupling member 174 is adapted to move axially a limited distance to disengage from the seat 170 and allow fluid in the interior of the conduit 26 to flow out into the annular passage 160 through radially extending ports 177 formed in the sidewall of the retaining collar 176.

When the pump 12 is being inserted into the conduit 24 fluid may be displaced through the space 160 and/or through the passage formed by seat 162 into the wellbore 14 if the conduit 26 has a standing column of fluid therein. Once the pump 12 is lowered to engage the end portion 31 with the seat 162, the bottom end of the space 160 formed by the conduit 24 is sealed and the conduit may be filled with pump driving fluid such as water. Although fluid will not be standing in the wellbore 14 from the formation to the surface, in most cases, some fluid will always be present at a height greater than the working position of the pump 12. Accordingly, as the pump is lowered toward engagement with the end cap 28, the chambers 54, 56, 62, and 64 will fill with fluid present in the wellbore and in the interior of the conduit 24. After the priming action which occurs inherently with positioning the pump 12 in a wellbore having fluid present therein the conduit 24 is then filled with the pump driving fluid. The amount of well or production fluid present in the wellbore 14 and the interior of the conduit 24 and which enters the chamber 56 is typically negligible in proportion to the total amount of fluid added after seating of the pump 12 in the end cap 28. However, if the fluid level present in the wellbore extends substantially toward the surface 18 the pump 12 should be lifted from engagement with the end cap 28 and water or another selected driving fluid pumped down into the interior of the conduit 24 and into the wellbore so that substantially all of the driving fluid during operation of the pump comprises a selected fluid column instead of the fluids naturally present in the wellbore.

Prior to pulling the pump 12 out of conduit 24 for modification or repair, the conduit 26 would typically be full of fluid. However, as the pump is lifted upward out of its seated condition, as shown in FIGS. 6, 6A and 6C, the coupling member 174 will move upward relative to the retaining collar 176 to permit fluid to flow out of the conduit 26 through the passage 175 and the ports 177 into the interior of the conduit 24. This permits pulling the pump 12 and the production fluid conduit 26 in a so-called dry condition which is desirable during pump servicing and other operations requiring withdrawal of the conduit 26 from the well.

Referring further to FIGS. 6A, 6B and 6C the housing 42 is characterized by two elongated tubular members 190 and 192 which are both provided with suitable internally threaded portions on their opposite ends. The housing member 190 is threadedly connected to the lower threaded end portion 168 of the head member 44 and to an upper externally threaded portion 194 of the partition member 46. The partition member 46 includes an opposed externally threaded end portion 196 coupled to one end of the lower housing member 192. The opposite end of the housing member 192 is threadedly coupled to a cooperating threaded portion 197 of head member 30.

Figure 8:
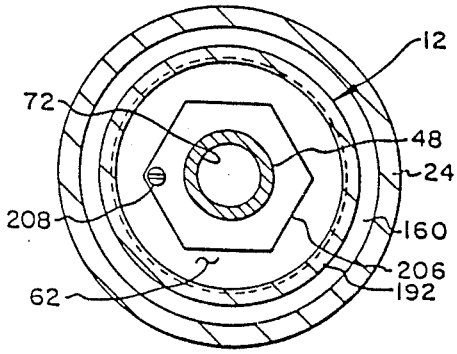
FIG. 8 is a transverse section view taken along the line 8—8 of FIG. 6B.

Referring to FIGS. 6B and 8, the partition member 46 includes an elongated central bore 200 which is threaded at its lower end and is formed with a transverse shoulder 202 at its upper end. The bore 200 forms a stuffing box for receiving suitable packing 204 which is retained in the bore by a packing nut 206. The nut 206 is suitably locked by a set screw 208 threadedly engaged therewith and with the lower end face of the partition 46. The packing 204 sealingly engages the tubular rod 48 of the piston assembly 47. O-ring seal members 210 are disposed in the partition 46 and in the packing nut 206 and also engage the rod 48 in sliding sealing engagement therewith. The production fluid flow passage 72 extends from the valve 70 to a chamber 214 formed in piston 50, FIG. 6B. A plurality of axially extending passages 216 open from the chamber 54 into the piston chamber 214. In like manner, the passage 72 may be in communication with a chamber 217 in piston 52, FIG. 6C, which is in communication with the chamber 62 through axially extending channels forming passages 218 formed in a separable, generally cylindrical piston member 227 forming a part of piston 52. The chamber 217 is also operable to be in communication with a passage 220 formed in the piston 52 and which opens into a further passage formed by an enlarged bore 222 for the check valve 67. The check valves 67, 70 and 33 are characterized as spherical ball type closure members and the valve 67 is engageable with a seat surface 224 formed between the passages 220 and 222. In like manner, the valve 70 is engageable with a seat surface 228 formed in the piston member 227 which is threadedly engaged with piston 52 at 233 and defines the passages 218. The piston rod 48 is secured to the piston member 227 by a nut 229 which is threadedly engaged with one end of the rod and with member 227 to provide for disassembly of the piston assembly 47 and access to the check valve closure members 67 and 70. Thanks to the arrangement of valves 67 and 70 a minimum amount of production fluid is retained in chamber 62 at the end of a production fluid delivery stroke. Accordingly, upon expansion of chamber 62 very little fluid is subject to release of entrained gas thereby avoiding a gas lock condition wherein fluid will not flow into chamber 62 from chamber 64 due to expansion of gas from fluid remaining in chamber 62. The valves 67 and 70 are also retained for limited movement by suitable retaining pins 230. The valve 33 is movable within an enlarged diameter passage 231 intersecting the passage 30 and forming a valve seat 232. A retaining pin 230 is also supported on the head member 30 for retaining the valve closure member within the passage 231.

The piston 52 includes an axially extending reduced diameter member 240 forming the passages 220 and 222 and operable to support a suitable chevron packing 244 for sealing engagement with the bore wall 193 of housing member 192. The piston member 240 in effect comprises a packing nut which is threadedly engaged with the piston 52 and has a head portion 246 engageable with a packing retaining washer 248. Fluid relief or lubricating passages 250 are formed in the piston 52 and open from chamber 217 to the bore wall 193 of the housing member 192.

Referring to FIG. 6B, the piston 50 is of similar construction and includes a removable head member 256 threadedly engaged therewith and defining the passages 216 and the cushion chamber 154. A separable packing nut 260 is threadedly engaged with the piston 50 and retains a chevron packing assembly 244 between a shoulder 251 and a washer 248. The nut 260 is provided with internal threads for threadedly coupling the piston 50 to the rod 48 and the nut 260 includes a passage 261 interconnecting chamber 214 with passage 72. A set screw 270 is threadedly engaged with the head 266 to assist in retaining the rod 48 in assembly with the nut 260.

The operation of the pump 12 is believed to be readily under standable from the foregoing description of the operation of the pumping system 10. However, briefly, when the piston assembly 47 is in the position illustrated in FIGS. 6A through 6C, the chamber 64 is at a minimum volume, chamber 62 is at maximum volume, chamber 56 is at minimum volume and chamber 54 is at maximum volume. As the piston assembly 47 moves upward in the housing 42 valve 67 closes and production fluid is displaced from chamber 62 through passages 218, 217, check valve 70 and through passage 72, chamber 214, passages 216 and into chamber 54. At the same time, of course, chamber 54 is being reduced in volume as fluid is discharged through passages 172 and 175 through the production fluid conduit 26. The chamber 56 is expanding in volume as driving fluid enters this chamber through the passages 74 in partition 46. The chamber 64 is expanding and drawing production fluid into the pump through passages 32 and 231 with check valve 33 in an open position. As the piston assembly 47 reaches the upper limit of its stroke it is cushioned by the projection 150 entering the cushion chamber 154 whereupon a substantially throttled flow of fluid through passage 155 is permitted to control the rate of deceleration of the piston assembly 47 as it moves toward the head member 44.

When the power transfer apparatus 40 has reached the limit of its stroke to displace driving fluid from chamber 100 and begins to displace fluid from chamber 98 the piston assembly 47 commences a downward stroke, viewing FIGS. 6A through 6C whereby check valve 33 will close to prevent flow of production fluid from chamber 64 through the passages 231 and 32. However, as chamber 64 is decreasing in volume chamber 62 is increasing in volume and fluid will transfer from chamber 64 to chamber 62 through passages 220, 222, 217 and 218. The substantial pressure from the standing column of production fluid in the production conduit 26 as well as the pressure buildup provided by the pressure relief valve 104 will cause check valve 70 to remain closed as fluid in conduit 26 returns to chamber 54 and urges the piston assembly 47 downwardly.

Figure 9A:
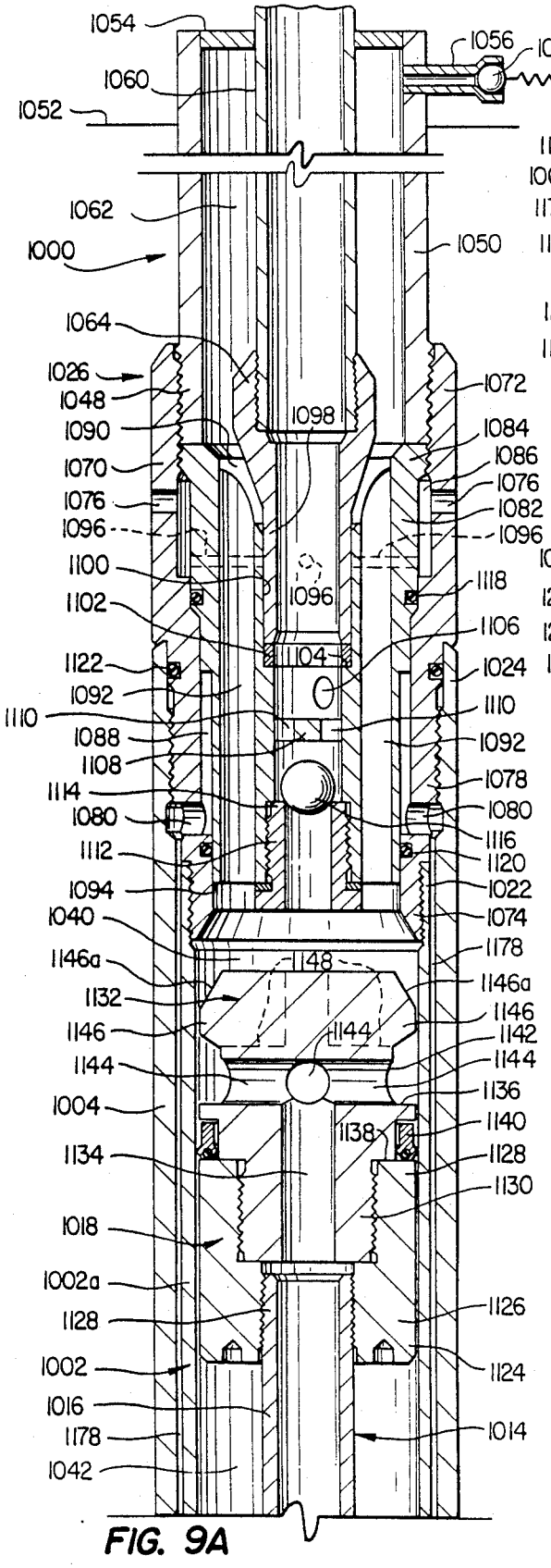
FIGS. 9A and 9B are cross-sectional views through longitudinal portions of an alternate embodiment of the well pump.
Figure 9B:
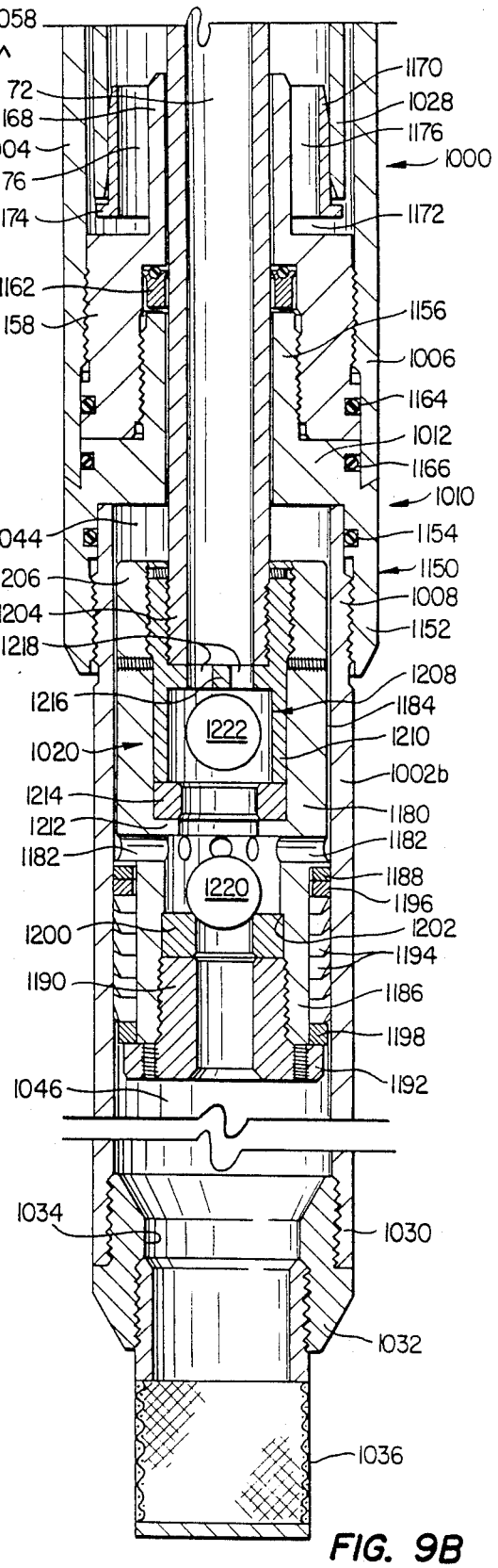

Cross-sectionally illustrated in FIGS. 9A and 9B are longitudinal sections of an alternate embodiment 1000 of the downhole pump 12. The operation of pump 1000 is similar to that of pump 12 shown in FIGS. 1–5, and like pump 12, pump 1000 is insertible in a well bore (not shown in FIGS. 9A and 9B) and is hydraulically drivable to pump production fluid to the surface. Compared to pump 12, however, pump 1000 has a variety of structural modifications which will now be described.

Pump 1000 includes an elongated tubular pump housing or barrel 1002 having an upper section $1002_a$ which is circumscribed by a tubular outer shell 1004, and a lower section 1002$_b$ which is connected to and projects downwardly from the shell 1004. Interposed between and interconnecting the lower end 1006 of shell 1004 and the upper end 1008 of barrel section 1002$_b$ is a divider assembly 1010 which defines within the interior of pump barrel 1002 an annular partition 1012. Piston means 1014 are provided within the interior of the pump barrel 1002 and include an elongated, hollow piston tube 1016 which extends through and is slidably received within the partition 1012. Secured to the upper end of tube 1016 is an upper or power piston assembly 1018, and secured to the lower end of tube 1016 is a lower or lift piston assembly 1020. The upper ends 1022, 1024 of the barrel section 1002$_a$ and the shell 1004 are respectively secured to an upper head or cap assembly 1026, with the lower end 1028 of barrel section 1002$_a$ being positioned slightly above the lower end 1006 of the shell 1004. Threaded into the lower end 1030 of barrel section 1002$_b$ is an inlet fitting 1032 having an inlet opening 1034. Threaded into inlet opening 1034 is the upper end of a conventional sand filter 1036.

The upper piston assembly 1018 is slidably mounted within the interior of the upper barrel section 1002$_a$ and divides it into a production fluid transfer chamber 1040 disposed between piston assembly 1018 and head assembly 1026, and a driving fluid chamber 1042 disposed between the piston assembly 1018 and the annular partition 1012. The lower piston assembly 1020 is slidably mounted within the interior of the lower barrel section 1002$_b$ and divides it into a production fluid delivery chamber 1044 disposed between the lower piston assembly 1020 and the partition 1012, and a production fluid intake chamber 1046 positioned between the lower piston assembly 1020 and the inlet fitting 1032.

Connected at its lower end 1048 to the upper head assembly 1026 is a production fluid pipe 1050 which extends upwardly through the wellbore to above the earth's surface 1052 and is closed at its upper end with a suitable cap 1054. Extending outwardly from the pipe 1050 at its upper end is a production fluid supply conduit 1056 having a spring-loaded check valve 1058 operatively disposed in its outer end.

The pump 1000 is hydraulically driven, in a manner subsequently described, by means of a driving fluid which is intermittently forced through a driving fluid pipe 1060 which extends downwardly through a central portion of the production fluid pipe 1050 and defines therewith an annular flow passage 1062 through which production fluid is upwardly pumped for discharge through the supply conduit 1056. Threaded onto the lower end of the driving fluid pipe 1060 is an annular stabber member 1064 which, in a manner subsequently described, engages the upper head assembly 1026. In operating the pump 1000, production fluid is preferably used as the driving fluid within the driving fluid pipe 1060. However, a driving fluid having a different specific gravity than that of the production fluid could be used if desired.

Referring first the FIG. 9A, the structural modifications in the pump 1000 will now be described. The upper head assembly 1026 includes a hollow, generally cylindrical body 1070 which has an internally threaded upper end portion 1072 into which is threaded the lower end of the production fluid pipe 1050, an externally threaded lower end portion 1074 onto which is threaded the upper end of barrel section 1002$_a$, a circumferentially spaced series of small drain ports 1076 positioned below the body upper end 1072, an externally threaded longitudinally intermediate portion 1078 onto which the upper end of shell 1004 is threaded, and a circumferentially spaced series of crossover outlet ports 1080 positioned between the body portions 1074 and 1078.

Coaxially received within the body 1070 is a hollow cylindrical crossover fitting 1082 which has an externally threaded upper end portion 1084 which is threaded into the upper body end 1072 below the production fluid pipe 1050. The fitting 1082 defines with the body 1072 an annular drain passage 1086 which communicates with the drain ports 1076, and an annular crossover passage 1088 which communicates with and extends upwardly from the crossover outlet ports 1080.

An upper end portion 1090 of the interior surface of fitting 1082 is conically downwardly tapered and has formed therethrough a circumferentially spaced series of downwardly extending production fluid outlet passages 1092 which extend through the bottom end 1094 of fitting 1082 and communicate with the production fluid transfer chamber 1040. Extending laterally outwardly through the interior surface of fitting 1082 just below the tapered interior surface portion 1090 are a circumferentially spaced series of interior drain ports 1096 which are positioned between the passages 1092 and communicate with the annular drain passage 1086.

As illustrated, a lower end portion 1098 of the annular stabber member 1064 is closely received within a cylindrical interior surface portion 1100 of the crossover fitting 1082 which extends downwardly from the tapered interior surface 1090 and has formed therethrough the interior drain ports 1096. The stabber member portion 1098 blocks the interior drain ports 1096 and engages at its lower end a compressible ferrule 1102 which rests upon an annular interior ledge 1104 formed within the crossover fitting. Extending laterally outwardly from the crossover fitting interior surface directly below ledge 1104 are a circumferentially spaced series of crossover inlet passages 1106 which extend between the production fluid outlet passages 1092 into the annular crossover passage 1088. Immediately below the passages 1106 the interior of the crossover fitting 1082 has a cylindrical partition 1108 which has around its periphery a circumferentially spaced series of passages 1110. Threaded into the lower end 1094 of the crossover fitting, radially inwardly of the passages 1092, is an annular valve seat 1112 which has an upper end 1114 that is spaced downwardly from the partition 1108. A metal ball 1116 is operatively carried by the valve seal 1112 for travel between its upper end 1114 and the partition 1108. The crossover fitting 1082 is sealed to the head assembly body 1070 by means of O-ring seals 1118 and 1120, and the body 1070 is sealed to the upper end 1024 of shell 1004 by means of an O-ring seal 1122.

Figure 10:
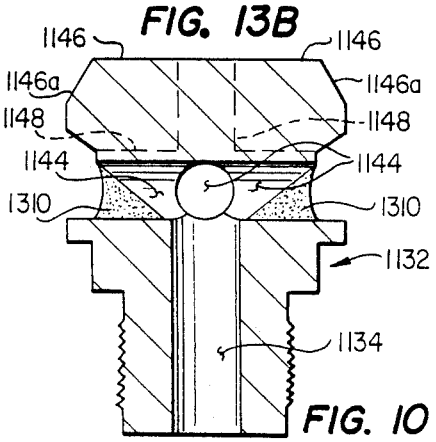
FIG. 10 is a cross-sectional view through the upper piston assembly dome portion of the pump illustrated in FIGS. 9A and 9B.
Figure 11:
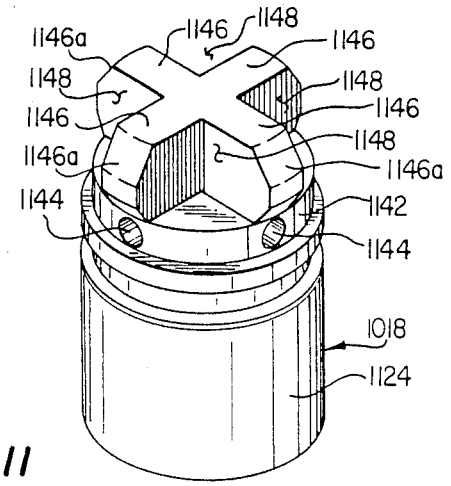
FIG. 11 is a reduced scale perspective view of the upper piston assembly.

Referring now to FIGS. 9A, 10 and 11, the upper piston assembly 1018 includes an annular lifter member 1124 having an interiorly threaded lower end portion 1126 into which is threaded an upper end portion 1128 of the piston tube 1016, and an interiorly threaded upper end portion 1128 which has a somewhat larger inner diameter. The lower end portion 1130 of a piston dome member 1132 is threaded into the upper end portion 1128 and has a central axial bore 1134 formed therein which communicates with the interior of the piston tube 1016. An upper end portion 1136 of the piston dome 1132 overlies the annular upper end 1138 of lifter member 1124 and is sealed thereto by means of a suitable annular seal member 1140. A circumferential groove 1142 is formed in the upper lifter member portion 1136 above the seal 1140 and has formed therein four equally circumferentially spaced, laterally extending outlet ports 1144 which communicate with the bore 1134. At the upper end of the piston dome 1132 are four circumferentially spaced, radially extending flutes 1146 which define therebetween four generally wedge-shaped upper end surface depressions 1148. Each of the flutes 1146 overlies and projects radially outwardly beyond one of the outlet ports 1144, and has an upwardly and inwardly tapered upper corner portion 1146$_a$.

Referring now to FIG. 9B, the divider assembly 1010, through which the piston tube 1016 slidably passes, includes a hollow cylindrical adapter fitting 1150 having an interiorly threaded lower end portion 1152 into which is threaded the upper end portion 1008 of the lower barrel section 1002$_b$, such upper end portion 1008 being sealed to the adapter fitting 1152 by means of an annular seal 1154. An annular upper end portion 1156 of the adapter fitting 1150 is threaded into the interior of an annular lower end portion 1158 of a body member 1160 and is interiorly sealed thereto by means of an annular seal member 1162. The lower end portion 1006 of the pump shell 1004 circumscribes and is threaded onto the lower end portion 1158 as illustrated, and is sealed to body portion 1158 and the adapter fitting 1150 by means of annular seals 1164 and 1166.

Projecting upwardly from the lower end portion 1158 of the body member 1160 is an annular upper end portion 1168 which has formed integrally therewith a laterally outwardly projecting annular dome portion 1170 which is spaced upwardly from the lower body end portion 1158 and defines therewith an annular space 1172. At the lower end of the dome 1170 is an annular, outwardly projecting flange 1174 which has an outer diameter somewhat less than the outer diameter of the lower body end portion 1158. Extending vertically through the dome 1170 is a circumferentially spaced series of passages 1176 which intercommunicate the annular space 1172 with the driving fluid chamber 1042. As illustrated, the lower end 1028 of the upper pump barrel section 1002$_a$ outwardly circumscribes and engages the dome 1170, with the lower end of barrel section 1002$_a$ being positioned slightly above the dome flange 1174. The upper barrel section 1002$_a$ defines with the pump shell 1004 an annular, vertically extending passage 1178 which communicates at its lower end with the annular space 1172 (FIG. 9B) and communicates at its upper end with the crossover outlet ports 1080 (FIG. 9A).

As illustrated in FIG. 9B, the lower piston assembly 1020 includes an annular piston body 1180 having a circumferentially spaced series of inlet ports 1182 extending through a longitudinally central portion thereof. The lower piston body 1180 has a maximum outer diameter slightly less than the inner diameter of the lower barrel section 1002$_b$ and defines therewith an annular passage 1184 which communicates at its lower end with the piston inlet ports 1182, and communicates at its upper end with the production fluid delivery chamber 1044. A lower end portion 1186 of the piston body 1180 is of a reduced diameter and defines an annular external shoulder 1188 immediately below the inlet ports 1182. An annular seat and seal retainer member 1190 is threaded into the bottom of the piston body portion 1186 and has an annular external flange 1192 which projects radially outwardly of the piston body portion 1186. Piston body portion 1186 is slidably sealed to the inner surface of lower barrel section 1002$_b$ by means of a plurality of annular seal members 1194 which are retained between a pair of step cut rings 1196 which engage the shoulder 1188, and an annular seal lifter 1198 which engages the retainer member flange 1192. An annular valve seat 1200 is captively retained within the interior of the annular piston body 1180 between the upper end of the retainer member 1190 and an annular, interior shoulder 1202 of the piston body.

A lower end portion 1204 of the piston tube 1016 is threaded into an upper portion 1206 of an annular piston lifter and cage 1208, portion 1206 being in turn threaded into an upper end portion of the lower piston body 1180. Extending downwardly from the upper end portion 1206 of the lifter and cage member 1208 is an annular skirt 1210 which terminates slightly above an annular internal flange portion 1212 of the piston body 1180, flange 1212 being positioned immediately above the piston inlet ports 1182. An upper annular valve seat 1214 is captively retained between the lower end of skirt 10 and the internal flange 1212. At the juncture of its upper end portion 1206 and its downwardly extending skirt 1210 the piston lifter and cage member 1208 is provided with a cylindrical internal partition 1216 which has a circumferentially spaced series of vertically extending holes 1218 formed therethrough, the holes 1218 intercommunicating the interior of the piston tube 1016 with the interior of the downwardly extending skirt 1210.

Captively retained within the interior of the lower piston body 1180 for movement between the lower valve seal 1200 and the internal flange 1212 is a lower metal valve ball 1220. Captively retained within the skirt 1210 for movement between the upper annular valve seat 1214 and the internal partition 1216 is an upper metal valve ball 1222.

The operation of pump 1000 is similar in principle to that of the pump 12 depicted in FIGS. 1–5. With the piston means 1014 at the lower limit of their downstroke, additional driving fluid is forced into the driving fluid pipe 1060 in a manner subsequently described. The fluid pressure increase in the pipe 1060 is transmitted to the annular undersurface of the upper piston assembly 1018 via the crossover passages 1106, 1088 and 1080, the elongated vertical annular passage 1178, the divider assembly passages 1172 and 1176, and the driving fluid chamber 1042. The increased fluid pressure in the driving fluid chamber 1042 drives the piston means 1014 upwardly in the pump barrel 1002. During upward movement of the piston means, the lower piston assembly valve ball 1220 is seated on its valve seat 1200 by virtue of the increasing pressure in the production fluid delivery chamber 1044, and the valve ball 1222 is lifted from its valve seat 1214.

Production fluid squeezed out of the production fluid delivery chamber 1044 is forced upwardly into the annular space 1062 between the production fluid pipe 1050 and the driving fluid pipe 1060 via the annular passage 1184, the lower piston inlet ports 1182, the interior of valve seat 1214, the vertical partition holes 1218, the interior of piston tube 1016, the upper piston outlet ports 1144, the gaps between the upper piston flutes 1146, the production fluid transfer chamber 1040, and the production fluid outlet passages 1092 in the crossover fitting 1082 of the head assembly 1026. Production fluid entering the annular flow passage 1062 is forced outwardly through the production fluid supply conduit 1056. When the pressure of the driving fluid within the driving fluid pipe 1060 is increased to drive the piston means 1014 upwardly as just described, the head assembly ball 1116 is normally driven into sealing engagement with its valve seat 1112. However, the ball 1116 and its seat 1112 function as a recirculating valve which permits upward flow of production fluid from the production fluid transfer chamber 1040 through the seat 1112 in the event that the fluid pressure on the underside of ball 1116 exceeds the downward driving fluid pressure on the upper surface of the ball.

During downward movement of the piston means 1014 the lower piston assembly ball 1122 is seated on its valve seat 1214, and the ball 1220 is lifted from its seat 1200. Accordingly, production fluid from the production fluid intake chamber 1046 is forced upwardly through the interior of retainer member 1190, outwardly through the lower piston ports 1182 and into the production fluid delivery chamber 1044 via the annular passage 1184 to refill the chamber 1044. Simultaneously, driving fluid from the driving fluid chamber 1042 is flowed back into the driving fluid pipe 1060 via the annular passage 1178 and the crossover passages 1080, 1088 and 1106.

Figure 12:
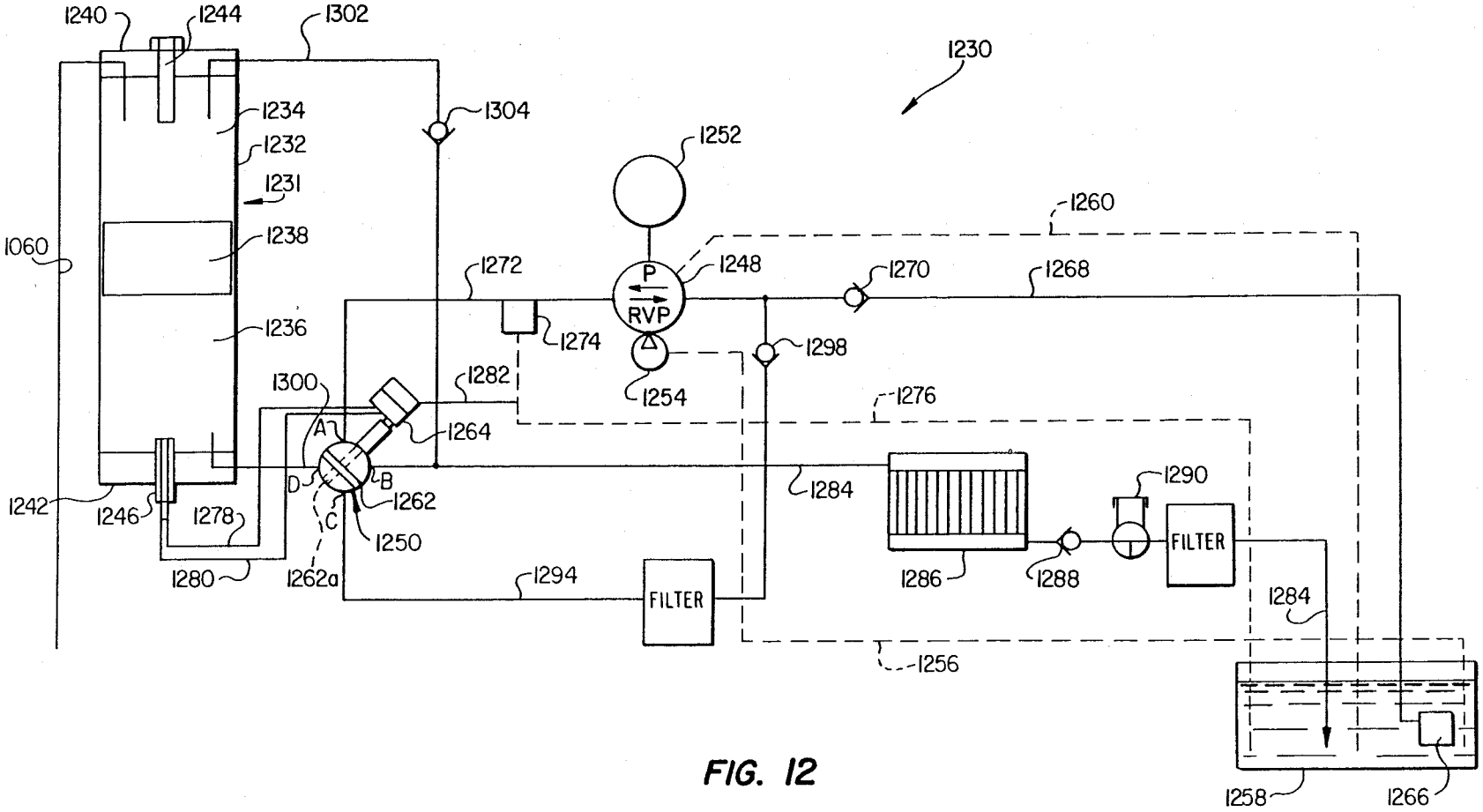
FIG. 12 is a schematic diagram of a power transfer system used to hydraulically drive the pump of FIGS. 9A and 9B.

The pump 1000 is hydraulically driven by a power transfer system 1230 located above-ground adjacent the wellhead and schematically depicted in FIG. 12. System 1230 includes an accumulator 1231 having a hollow isolator housing 1232 filled with driving fluid and having a cylindrical interior which is divided into upper and lower chambers 1234, 1236 by a piston 1238 operatively disposed therein for reciprocating motion toward and away from the housing's opposite upper and lower ends 1240, 1242. The upward travel of piston 1238 may be selectively limited by an adjustable travel stop 1244 mounted on the upper housing end 1240, while the proximity of piston 1238 to the lower end wall 1242 is sensed by a proximity sensor 1246 secured thereto.

Piston means 1014 of pump 1000 are upwardly driven, via the power transfer system piston 1230, by means of a variable volume, closed loop, reversible driving fluid pump 1248 that operates in conjunction with a reversible four-way valve 1250. Pump 1248 is driven by a motor 1252 and has operatively connected thereto a charge pump 1254 that functions in a conventional manner to replenish leakage in the pump 1248. The charge pump 1254 has an inlet conduit 1256 connected at its open outer end to a driving fluid reservoir 1258, and a discharge conduit 1260 interconnected between the inlet side of pump 1248 and the reservoir 1258.

The valve 1250 has four ports A, B, C and D, and a schematically depicted internal member 1262 which is movable by a switch 1264 between a first position (shown by solid lines in FIG. 12) in which ports A and B communicate, and ports C and D communicate, and a second position (shown by dotted lines in FIG. 12 and indicated by the reference numeral 1262$_a$) in which ports A and D communicate, and ports B and C communicate.

Interconnected between the inlet of pump 1248 and a suction strainer 1266 disposed in the reservoir 1258 is an inlet conduit 1268 which has a check valve 1270 installed therein. Connected between the outlet side of pump 1248 and port A of valve 1250 is a pump discharge conduit 1272. A pressure relief valve 1274 is installed in the discharge conduit 1272 and has a discharge line 1276 which is extended into the driving fluid reservoir 1258. A pair of outlet leads 1278, 1280 from the proximity sensor 1246 are operatively connected to the valve switch 1264 which also has a sensing conduit 1282 connected to the pressure relief valve discharge line 1276.

A conduit 1284 is connected to port B of the valve 1250 and is extended into the reservoir 1258, the conduit 1284 having operatively installed therein, in a left-to-right sequence in FIG. 12, a full flow oil cooler 1286, a check valve 1288, a manual three-way filler valve 1290, and a low pressure filter 1292. Interconnected between port C of valve 1250 and the pump inlet conduit 1268 between the pump 1248 and the check valve 1270 is a conduit 1294 which has operatively installed therein a high pressure filter 1296 and a check valve 1298. Extending from port D of the valve 1250 into the lower chamber 1236 of the housing 1232 is a conduit 1300. Finally, a fluid make-up conduit 1302 is interconnected between the upper chamber 1234 of housing 1232 and the conduit 1284 between the valve 1250 and the oil cooler 1286, the conduit 1302 having operatively installed therein a check valve 1304.

With the piston means 1014 of pump 1000 in their lowermost position within the pump barrel, the piston 1238 is in its lowermost position within the housing 1232 and the proximity sensor 1246, via the leads 1278, 1280 and the valve switch 1264 has moved the internal member 1262 of valve 1250 to its second position 1262$_a$. The pump 1248 draws driving fluid from the reservoir 1258 through the inlet conduit 1268 and check valve 1270, and discharges the fluid via the discharge conduit 1272, the ports A and D of the valve 1250 and the conduit 1300 into the lower chamber 1236 of the housing 1232. Driving fluid forced into the lower chamber 1236 forces the piston 1238 upwardly toward the travel stop 1244. Such upward travel of the piston 1238 forces driving fluid from the upper chamber 1234 into and downwardly through the driving fluid pipe 1060 into the pump 1000 to thereby force the piston means 1014 upwardly in the barrel of the pump 1000.

As the piston means 1014 approach the upper limit of their stroke, the housing piston 1238 approaches the upper limit of its stroke within the housing 1232 and the fluid pressure in the pump discharge conduit 1272 is increased to an extent that the pressure relief valve 1274 opens and flows pump discharge fluid into the reservoir 1258 via the pressure relief valve discharge line 1276. The increased pressure in discharge line 1276 is sensed by the sensing conduit 1282 which energizes the valve switch 1264 to move the valve internal member 1262 to its first position.

A significant portion of the potential energy stored in the piston means 1014 at the upper end of their stroke is now recaptured and utilized to reduce the overall power consumption of the pump 1248 in the following manner. With the four-way valve 1250 switched to its first position, the piston means 1014 are simply allowed to slowly fall through their downstroke within the barrel of pump 1000. As such piston means slowly fall, driving fluid is forced upwardly through the driving fluid pipe 1060 and into the upper chamber 1234 of the isolator housing 1232. Driving fluid forced into the upper chamber 1234 forces the piston 1238 downwardly within the housing 1232. Downward movement of the piston 1238 forces driving fluid outwardly from the lower chamber 1236 and into the inlet of pump 1248 via the conduit 1300, the ports D and C of the valve 1250, the conduit 1294, the check valve 1298, and the inlet conduit 1268. Driving fluid, now pressurized by the falling piston means 1014, enters and is forced through the pump 1248 and into the driving fluid reservoir 1258 via the discharge conduit 1272, ports A and B of the valve 1250 and the conduit 1284. Depending on the relative pressures involved, a portion of this driving fluid may be forced upwardly through the make-up conduit 1302 into the upper housing chamber 1234.

It can be seen that the driving fluid forced into and through the pump 1248 by the falling piston means 1014 serves to reduce the power consumption on the pump motor 1252 during this half of the operating cycle of system 1230, thereby increasing the overall power consumption efficiency of the system. As the piston 1238 downwardly approaches the proximity sensor 1246, the sensor energizes the valve switch 1264 to return the valve's internal member 1262 back to its second position 1262$_a$, and the previously described operating cycle of the system 1230 begins again.

Figure 13A:
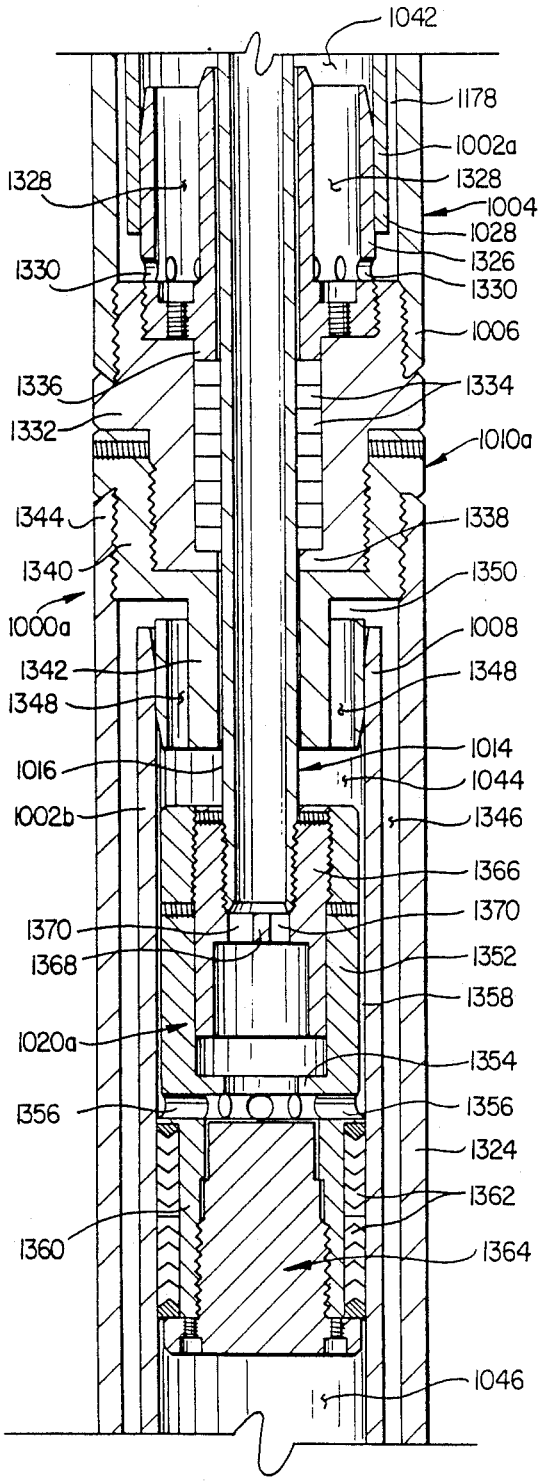
FIGS. 13A and 13B are cross-sectional views through longitudinal portions of a modified lower half of the pump illustrated in FIGS. 9A and 9B.
Figure 13B:
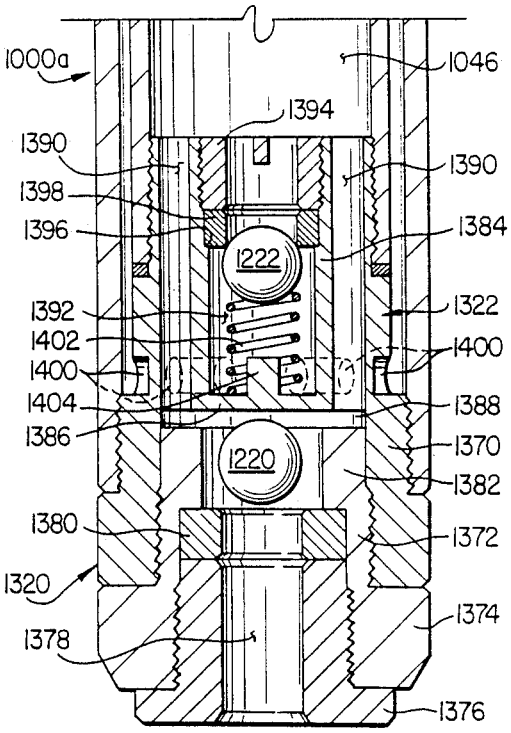

Cross-sectionally illustrated in FIGS. 13A and 13B are lower longitudinal sections of an alternate embodiment 1000$_a$ of the pump 1000. Pump 1000$_a$ is provided with a modified divider assembly 1010$_a$, a modified lower piston assembly 1020$_a$ connected to the lower end of the piston tube 1016, a modified inlet end portion 1320, a stationary valve assembly 1322 and a lower shell section 1324. Above its modified divider assembly 1010$_a$, the pump 1000$_a$ is identical in construction to the previously described pump 1000.

The divider assembly 1010$_a$ includes an annular barrel guide member 1326 which circumscribes the piston tube 1026 and is extended into the lower end portion 1028 of the upper barrel section 1002$_a$. Member 1326 has an annular passage 1328 formed therein which communicates with the driving fluid chamber 1042 and with the annular passage 1178 via a circumferentially spaced series of ports 1330. The member 1326 is threaded into an annular divider block member 1332 which is sealed to the piston tube 1026 by a series of annular packing washers 1334 retained between an annular skirt 1336 on member 1326 and an internal flange 1338 on the divider block 1332. The divider block 1332 is threaded into an annular divider adapter member 1340 having a downwardly projecting annular dome portion 1342 which is received in a non-threaded upper end portion 1008 of the lower barrel section 1002$_b$.

An upper end portion 1344 of the shell section 1324 is threaded onto the divider adapter 1340 and defines with the lower barrel section 1002$_b$ an annular, vertically extending passage 1346. The dome 1342 has formed therein a circumferentially spaced series of vertically extending passages 1348 which communicate with the production fluid delivery chamber 1044 at their lower ends, and communicate at their upper ends with the annular passage 1346 via an annular passage 1350 defined between the dome 1342 and the balance of the divider adapter 1340.

The lower piston assembly 1020$_a$ includes an annular piston body 1352 having an annular internal flange 1354 and a circumferentially spaced series of ports 1356 which are positioned immediately below the flange 1354 and communicate with the production fluid delivery chamber 1044 via a small annular passage 1358 defined between the piston body and the lower barrel section 1002$_b$. A lower end portion 1360 of the piston body 1352 is slidably sealed to the interior surface of the lower barrel section 1002$_b$ by a series of annular seal members 1362 and is closed by an annular plug member 1364 threaded thereinto. An annular piston lifter member 1366 is threaded into the piston body 1352 above the internal flange 1354 and has a cylindrical divider portion 1368 having formed therein a circumferentially spaced series of vertically extending holes 1370 which communicate with the interior of the piston tube 1016 and with the ports 1356 via the interiors of the piston body 1352 and the piston lifter 1366. As illustrated, the lower end of the piston tube 1016 is threaded into the piston lifter 1366 above the divider 1368. It should be noted that the valve balls 1220 and 1222 in the pump 1000$_a$ are relocated from the lower piston assembly to the stationary valve assembly 1322 which will now be described.

The stationary valve assembly 1322 includes a valve body member 1370 which is threaded into the lower end of the barrel section 1002$_b$. A lower end portion of the valve body member 1370 is threaded into an annular spacer member 1372 which is in turn threaded into the lower end of the shell section 1324. An annular valve cage member 1374 is threaded into the spacer member 1372, and an annular seat keeper member 1376 is threaded into the valve cage member 1374, the interior 1378 of the seat keeper member 1376 defining the well fluid inlet of the pump 1000$_a$. An annular lower valve seat 1380 is captively retained between the upper end of the seat keeper 1376 and an annular internal flange portion 1382 of the valve cage member 1374.

The upper end portion 1384 of the valve body member 1370 is of a generally cylindrical configuration and has a lower wall portion 1386 which is positioned slightly above the annular internal flange 1382 and defines therewith an annular space 1388 which communicates with the inlet passage 1378 via the interiors of the flange 1382 and the lower valve seat 1380. The upper end portion 1384 of the valve body 1370 has formed therethrough, adjacent its outer periphery, a circumferentially spaced series of vertically extending passages 1390 which intercommunicate the production fluid intake chamber 1046 with the annular passage 1388. Such upper end portion 1384 also has formed therein a cylindrical, vertically extending central recess 1392 having an annular upper seat keeper member 1394 threaded into an upper end portion thereof. Captively retained between the lower end of the seat keeper 1394 and an annular ledge portion 1396 of the upper end portion 1384 is an annular upper valve seat 1398. A circumferentially spaced series of ports 1400 extend outwardly from the recess 1392 between the vertical passages 1390 and into the vertically extending annular passage 1356 defined between the lower barrel section 1002$_b$ and the lower shell section 1324.

The upper valve ball 1222 is captively retained within the recess 1392 for vertical movement toward and away from the upper valve seat 1398 and is biased upwardly toward seating engagement with the valve seat 1398 by a valve spring 1402 whose lower end circumscribes a cylindrical boss 1404 projecting upwardly from the lower wall 1386. The lower valve ball 1220 is captively retained within the interior flange 1382 for vertical movement between the lower wall 1386 and the lower valve seat 1380.

During upward movement of the piston means 1014 the upper valve ball 1222 is seated on its valve seat 1398, and the lower valve ball 1220 is lifted off of its valve seat 1380. Accordingly, during such upward travel of the piston means, well fluid is drawn inwardly through the inlet 1378 and into the expanding production fluid intake chamber 1046. Simultaneously, production fluid in the production fluid delivery chamber 1044 is forced downwardly through the narrow annular passage 1358, radially inwardly through the lower piston ports 1356, and upwardly into the interior of the piston tube 1016 (via the ports 1370 in the cylindrical divider member 1368) for ultimate discharge from the pump 1000$_a$.

During downward travel of the piston means 1014, the upper valve ball 1222 is forced downwardly off its valve seat 1398 and the lower valve ball 1220 is reseated on the lower valve seat 1380. Accordingly, production fluid in the production fluid intake chamber 1046 is forced downwardly into the central recess 1392, laterally outwardly through the ports 1400 into the vertically extending annular passage 1346, upwardly through passage 1346, laterally inwardly through the annular passage 1350, downwardly through the vertical passages 1348 of the dome 1342 and into the production fluid delivery chamber 1044 to refill such chamber.

From the foregoing it can be seen that the valve balls 1220 and 1222 together with their associated valve seats in pumps 1000 and 1000$_a$ define in such pumps a duality of reverse acting one way valve means which are maintained in a fixed relative positional relationship during operation of such pumps. As used herein, the term "reverse acting" means that when one of the valves is opened the other one is closed, and vice versa. In the case of pump 1000 the two valve means or ball check valves are carried by the piston means for movement therewith. In the case of the pump 1000$_a$ just described, the two valve means or ball check valves are maintained in a fixed relationship relative to the pump barrel by means of the stationary valve assembly 1322.

The pumps 1000 and 1000$_a$ offer a variety of operating advantages over conventional downhole well pumps—particularly those of the sucker rod type. For example, in sucker rod pump systems there is considerable system "stretch" during operation. This system stretch, which occurs primarily in the greatly elongated actuating rod that is alternately subjected to tension and compression forces, is mechanical in nature and, importantly, occurs "downhole" where it is difficult, if not impossible, to precisely adjust and/or compensate for. This mechanical, downhole stretch problem is essentially eliminated in the present invention by virtue of the fact that the piston tubes of pumps 1000 and 1000$_a$ (like the piston tubes of various other pumps disclosed herein) are relatively short compared to the greatly elongated driving fluid and production fluid pipes, and are maintained in a constant state of tension during pump operation.

The substantial elimination of mechanical stretch also permits the compression ratio of pumps 1000 and 1000$_a$, as in the case of other pumps disclosed herein, to be optimized and precisely calibrated during the above-ground pump assembly process. More specifically, unlike the situation in sucker rod-type pumps, there is simply no guesswork involved as to where the lower piston will be, relative to the pump inlet, at the lower limit of its downstroke. Its precise downstroke location relative to the inlet is established during the above-ground pump assembly process, and is reliably maintained during the downhole operation of the pump.

This is not to say that there is no system "stretch" in the hydraulically driven pump systems of the present invention-such stretch indeed exists. However, and very importantly, such stretch is not mechanical but is hydraulic and may be easily and rapidly compensated for, and controlled above-ground, by making suitable adjustments to the power transfer system. To facilitate and augment this hydraulic adjustment ability, using the power transfer system 1230 as an example, it is preferable that the driving fluid displacement capacity of the power transfer system be larger than the sum of the mechanical displacement volume of the well pump plus the compressability volume of the driving fluid in the driving fluid pipe arising from the pressure force interaction between the power transfer system and the well pump. Such compressability volume includes the actual compression volume of the driving fluid plus the pressure-caused "bulge" volume of the driving fluid pipe.

Figure 14:
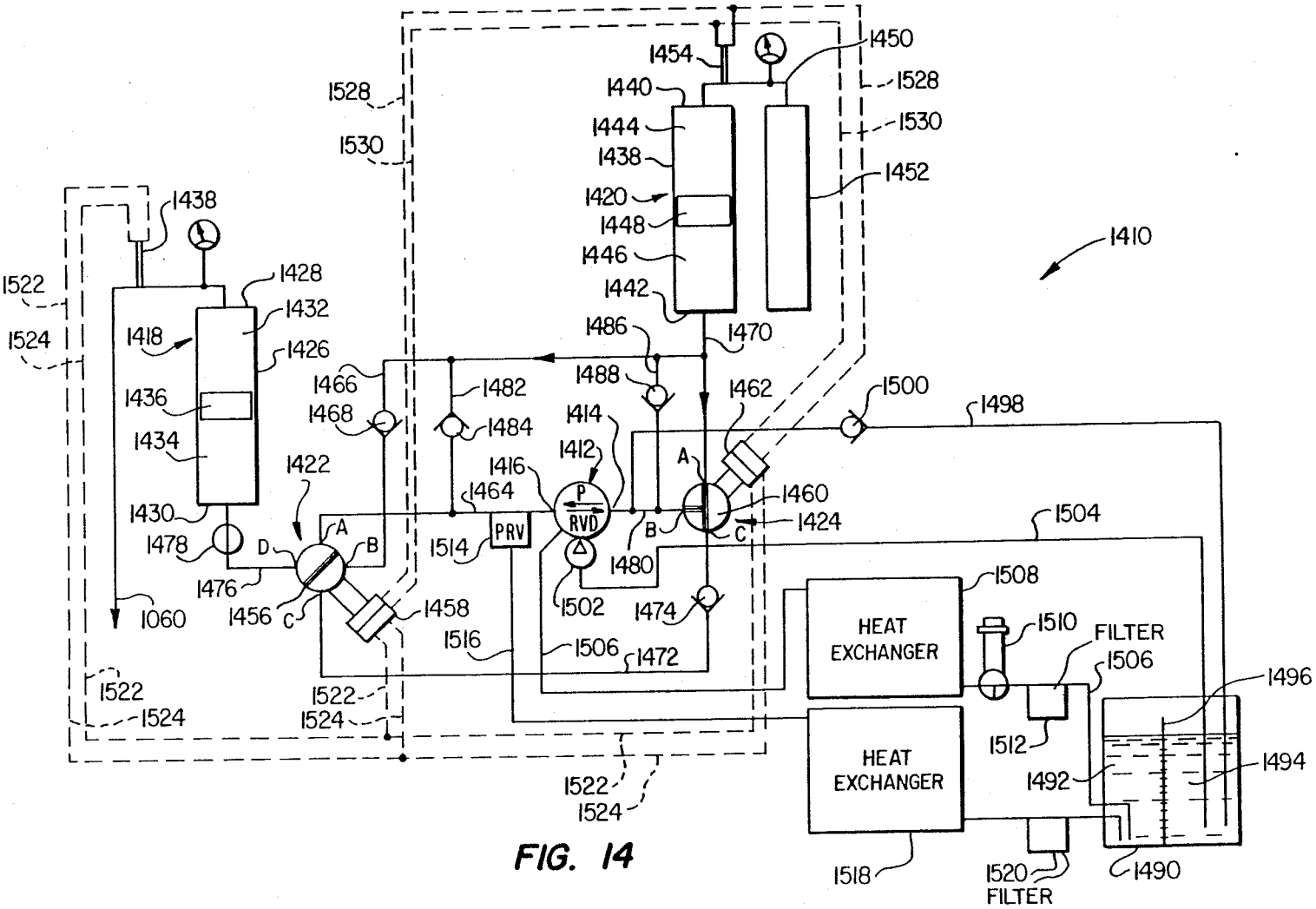
FIG. 14 is a schematic diagram of an alternate embodiment of the power transfer system of FIG. 12.

As previously mentioned, the power transfer system 1230 depicted in FIG. 12 utilizes a portion of the potential energy stored in the piston means 1014 of pump 1000 or 1000$_a$ to assist in driving the system pump 1248 during the "downstroke" half of its cycle in which the well pump piston means 1014 are falling through their downstroke. Illustrated in FIG. 14 is a power transfer system 1410 which constitutes an alternate embodiment of the previously described power transfer system 1230. System 1410 utilizes a variable volume, closed loop reversible driving fluid pump 1412, with high pressure capability on both sides thereof, having an inlet 1414 and an outlet 1416. As will be seen, the system 1410 utilizes stored potential energy in the well pump piston means 1014 to assist in driving the pump 1412 during both the upstroke and downstroke portions of its cycle, to thereby reduce the power consumption of its driving motor (not shown).

System 1410 includes a first accumulator or isolator 1418, a second accumulator 1420, a reversible four-way valve 1422, and a reversible three-way valve 1424. Accumulator 1418 has a cylindrical housing 1426 which has upper and lower ends 1428, 1430 and an interior divided into upper and lower chambers 1432, 1434 by a free piston 1436 disposed therein for movement between the upper and lower housing ends 1428, 1430. An upper end of the driving fluid pipe 1060 communicates with the upper housing chamber 1432 and has a pressure sensing switch 1438 operatively positioned therein. Each of the housing chambers 1432, 1434 are filled with driving fluid.

The second accumulator 1420 has a cylindrical housing 1438 having upper and lower ends 1440, 1442 and an interior which is divided into upper and lower chambers 1444, 1446 by a free piston 1448 disposed therein for movement between the upper and lower housing ends 1440, 1442. The upper chamber 1442 is filled with a pressurized gas such as nitrogen which is supplied thereto via a gas supply conduit 1450 interconnected between the upper housing chamber 1440 and a suitable gas storage tank 1452. A pressure sensing switch 1454 is operatively installed in the conduit 1450. The lower housing chamber 1446 is filled with driving fluid.

The four-way valve 1422 has four ports A, B, C and D, and a schematically depicted internal member 1456 which is movable by a switch 1458 between an upstroke position (illustrated in FIG. 14) in which ports A and D communicate, and ports B and C communicate, and a downstroke position (not shown in FIG. 14) in which ports A and B communicate and ports C and D communicate.

The three-way valve 1424 has three ports A, B and C and a schematically depicted internal member 1460 which is movable by a switch 1462 between an upstroke position (shown in FIG. 14) in which ports A and C communicate with each other and with port B, and a downstroke position (not shown in FIG. 23) in which ports B and C communicate, and fluid flow through port A is precluded.

The valve 1422 is interconnected to the balance of the system 1410 by means of a conduit 1464 interconnected between its port A and the outlet 1416 of pump 1412; a conduit 1466 having a check valve 1468 therein and interconnected between port B of valve 1422 and a conduit 1470 extending between housing chamber 1446 and port A of valve 1424; a conduit 1472 extending between its port C and port C of valve 1424 and having a check valve 1474 therein; and a conduit 1476 interconnected between its port D and the lower chamber 1434 of the accumulator housing 1426 and having a manual on/off valve 1478 installed therein.

Port B of the three-way valve 1424 is connected to the inlet 1414 of pump 1412 by a conduit 1480. The conduits 1464 and 1466 are interconnected by a conduit 1482 having a check valve 1484 operatively installed therein. Similarly, the conduits 1466 and 1480 are interconnected by a conduit 1486 having a check valve 1488 operatively installed therein.

The power transfer system 1410 is also provided with a driving fluid reservoir 1490 whose driving fluid-filled interior is divided into chambers 1492 and 1494 by a suitable perforated baffle 1496. A pump inlet conduit 1498, having an anti-cavitation check valve 1500 installed therein, is extended between the reservoir chamber 1494 and the conduit 1480. The pump 1412 has operatively connected thereto a conventional charge pump 1502 having an inlet conduit 1504 which extends into the reservoir chamber 1494. Charge pump 1502 also has a discharge conduit 1506 which is extended into the reservoir chamber 1492 via a pump case heat exchanger 1508, a manual filler valve 1510, and a high pressure filter 1512. A conventional pressure relief valve 1514 is installed in the pump discharge conduit 1464 and has a fluid vent conduit 1516 which is extended into the reservoir chamber 1492 via a system relief heat exchanger 1518 and a high pressure filter 1520.

With the well pump piston means 1014 at the bottom of their downstroke, the first accumulator piston 1436 is at the bottom of its stroke, the second accumulator piston 1448 is at the upper end of its stroke, and the internal valve members 1456, 1424 of the valves 1422, 1424 have been switched (in a manner subsequently described) to their illustrated upstroke positions. The system pump 1412 draws driving fluid from the reservoir chamber 1494 via the inlet conduit 1498 and check valve 1500 into its inlet 1414, and discharges the driving fluid through its outlet 1416 into the first accumulator housing lower chamber 1434 via the discharge conduit 1464, the ports A and D of valve 1422, and the conduit 1476. Driving fluid forced into the housing chamber 1434 forces the piston 1436 upwardly to thereby force driving fluid in the upper chamber 1432 into and downwardly through the driving fluid pipe 1060. Driving fluid forced downwardly through pipe 1060 forces the well pump piston means 1014 upwardly. During at least an initial portion of this upstroke phase of the operation of pump 1412, the gas pressure in the second accumulator housing upper chamber 1444 forces the piston 1448 downwardly to thereby force driving fluid in chamber 1446 through the pump 1412 via conduit 1470, ports A and B of valve 1424, and conduit 1480. As will be seen, the piston 1448 has previously been moved upwardly in housing 1438 by a unique transfer of potential energy from the well pump piston means 1014 to the second accumulator 1420. Additional driving fluid from the lower housing chamber 1446 of accumulator 1420 is caused to bypass the pump 1412 and be forced directly into discharge conduit 1464 via conduit 1470, the conduit 1466, the conduit 1482 and the check valve 1484. This driving fluid which bypasses the system pump 1412 is forced directly into the lower housing chamber 1434 of the first accumulator 1418 via the conduit 1464, ports A and D of valve 1422, and the conduit 1476. As the accumulator piston 1448 approaches the lower limit of its downstroke, the flow rate of driving fluid from chamber 1446 which is forced through and around the pump 1412 gradually lessens and the inlet flow rate through conduit 1498 increases.

As the well pump piston means 1014 approach the top of their upstroke, the first accumulator piston 1436 approaches the top of its upstroke, and the second accumulator piston 1448 approaches the bottom of its downstroke. When the first accumulator piston 1436 reaches the top of its upstroke, the pressure in the driving fluid pipe 1060 reaches a predetermined value and activates the pressure sensing switch 1438. Via electrical leads 1522, 1524 the pressure switch 1438 activates the valve switches 1458, 1462 to reverse the internal valve members 1456, 1460 to their "downstroke" positions. This permits the well pump piston means 1014 to fall through their downstroke as previously described.

Such fall of the well pump piston means forces driving fluid into the first accumulator housing chamber 1432 to thereby drive the accumulator piston 1436 downwardly. Downward movement of the piston 1436 forces driving fluid from the lower chamber 1434 into and through the system pump 1412 via conduit 1476, ports D and C of valve 1422, conduit 1472, check valve 1474, ports C and B of valve 1424, and conduit 1480. In this manner, a portion of the potential energy stored in the well pump piston means is utilized to directly drive the system pump 1412 during the downstroke portion of its cycle to thereby reduce its power consumption.

However, an additional portion of the such potential energy is transferred to the second accumulator 1420 in the following manner. A portion of the driving fluid which is flowed leftwardly through conduit 1480 during the initial phase of the downstroke cycle of pump 1412 is flowed upwardly through conduit 1486 and the check valve 1488 into the lower accumulator chamber 1446 via the conduit 1466 and the conduit 1470. Additionally, all of the driving fluid forced through the pump 1412 into discharge conduit 1464 is also forced into the accumulator housing chamber 1446 via ports A and B of valve 1422, the conduit 1466 and the check valve 1468, and the conduit 1470. Entry of the driving fluid into the accumulator chamber 1446 drives the piston 1448 upwardly in the housing 1438 against the pressure of the gas in the upper chamber 1444. In this manner, a portion of the stored potential energy in the well pump piston means is also transferred to the second accumulator 1420.

As the well pump piston means reach the lower limit of their downstroke the accumulator piston 1436 reaches the lower limit of its downstroke and the accumulator piston 1448 reaches the upper limit of its upstroke and the downstroke cycle of the system 1410 is completed. At this point, the pressure in the upper housing chamber 1444 reaches a predetermined upper level to thereby energize the pressure sensor 1454. Via electrical leads 1528 and 1530, the pressure switch 1454 then activates the valve switches 1458, 1462 to reverse the valve members 1456, 1460 of valves 1422, 1424 to their "upstroke" positions, thereby causing the system 1410 to initiate its upstroke cycle again.

To broadly summarize the interaction between the well pump and the power transfer system 1410, during the downstroke cycle of the system, a first portion of the stored potential energy in the well pump piston means is used to directly drive the system pump 1412, while a second portion of such stored potential energy is transferred to the second accumulator 1420. During the upstroke cycle of the system 1410, a first portion of the potential energy stored in the second accumulator 1420 is used to directly drive the first accumulator 1418, while a second portion of the stored potential energy is used to directly drive the system pump 1412. In this unique manner, a significant portion of the potential energy of the well pump piston means is utilized to reduce the power consumption of the system pump 1412 during both its upstroke and downstroke cycles.

Although preferred embodiments of the present invention have been described in detail herein those skilled in the art will recognize that various substitutions and modifications may be made to the various components of the invention without departing from the scope and spirit thereof as recited in the appended claims.

What I claim is:

1. Power transfer apparatus for causing vertical reciprocation of piston means in a downhole well pump operatively disposed in a wellbore, said well pump having a driving fluid chamber therein adapted to receive a quantity of driving fluid to responsively cause said piston means to lift, and to discharge the received driving fluid during downward movement of said piston means, said apparatus comprising:

a driving fluid housing having first and second opposite ends;

a drive piston disposed in said housing and dividing the interior thereof into a first chamber disposed between said drive piston and said first end of said housing, and a second chamber disposed between said drive piston and said second end of said housing;

a driving fluid pipe having a first end in fluid communication with said first chamber, and a second end adapted for connection to said well pump in fluid communication with said driving fluid chamber of said well pump, said first chamber and said driving fluid pipe, when operatively connected to said driving fluid chamber of said well pump, being adapted to be filled with a first driving fluid;

a driving fluid pump having an inlet adapted to receive a second driving fluid from a source thereof, and an outlet adapted to discharge the received second driving fluid; and means for alternately:

(1) causing said driving fluid pump to draw second driving fluid from said source thereof and discharge second driving fluid into said second chamber to force said drive piston toward said first housing end to thereby force first driving fluid out of said first chamber and into said driving fluid pipe to force first driving fluid from within said driving fluid pipe into said driving fluid chamber of said well pump to cause said piston means in said well pump to rise, and (2) permitting said piston means in said well pump to fall to thereby force first driving fluid from said driving fluid chamber into said driving fluid pipe, and from within said driving fluid pipe into said first chamber, in a manner moving said drive piston toward said second housing end and responsively forcing second driving fluid outwardly from said second chamber and inwardly through said inlet of driving fluid pump to assist in driving the same during downward movement of said piston means in said well pump.

2. The apparatus of claim 1 wherein said last-mentioned means include:

conduit means interconnecting said inlet of said driving fluid pump, said outlet of said driving fluid pump, and said second chamber, four-way valve means operatively connected in said conduit means and being reversible between first and second positions to alter the flow paths therethrough, switch means operable to reverse the position of said four-way valve means, means for sensing the proximity of said drive piston to said second end of said housing and responsively activating said switch means to reverse said four-way valve means from said first position to said second position, and means for sensing the discharge pressure of said driving fluid pump and responsively activating said switch means to reverse said four-way valve means from said second position to said first position.

3. The apparatus of claim 1 wherein said driving fluid pump is a variable volume, closed loop reversible pump.

4. The apparatus of claim 1 wherein:

said well pump has a mechanical displacement volume equal to the operative stroke volume of said piston means, the first driving fluid extending within said driving fluid pipe between said power transfer apparatus and said well pump has a compressability volume equal to the total volume by which such first driving fluid is compressed during fluid-driven upward movement of said piston means in said well pump, and the maximum volume of first driving fluid displaceable from said first chamber into said driving fluid pipe is greater than the sum of said mechanical displacement volume of said well pump and said compressability volume of the first driving fluid extending within said driving fluid pipe between said power transfer apparatus and said well pump.

5. Surface-disposed power transfer apparatus for hydraulically causing vertical reciprocating movement of piston means in a downhole well pump operatively disposed in a wellbore, said well pump having a driving fluid chamber therein adapted to receive a quantity of driving fluid to responsively cause said piston means to lift, and to discharge the received driving fluid during downward movement of said piston means, said apparatus comprising:

a driving fluid pipe having a first end, and a second end adapted for connection to said well pump in fluid communication with said driving fluid chamber therein;

pump means having an inlet for receiving driving fluid from a source thereof, and an outlet for discharging the received driving fluid; and means interconnected between said pump means and said first end of said driving fluid pipe for alternately utilizing said pump means to force driving fluid downwardly through said driving fluid pipe to move said piston means through an upstroke, and then permitting said piston means to fall through a downstroke to force driving fluid upwardly through said driving fluid pipe, and into and through said pump means to assist in driving said pump means.

* * * * *

UNITED STATES PATENT AND TRADEMARK OFFICE

CERTIFICATE OF CORRECTION

PATENT NO. : 4,880,363

DATED : November 14, 1989

INVENTOR(S) : John and Martin Holland and Associates

It is certified that error appears in the above-identified patent and that said Letters Patent is hereby corrected as shown below:

Col. 3, lines 54 - 68 should be deleted in their entirety.

Col. 4, lines 1 - 14 should be deleted in their entirety.

Col. 6, line 37 "mulators, 106" should read --mulators 106--.

Col. 17, line 14 "1122" should read --1222--.

Signed and Sealed this

Second Day of July, 1991

*Attest:*

HARRY F. MANBECK, JR.

*Attesting Officer*

*Commissioner of Patents and Trademarks*